US008167303B2

(12) United States Patent
Kamiya

(10) Patent No.: US 8,167,303 B2
(45) **Date of Patent: *May 1, 2012**

(54) SHEET PROCESSING APPARATUS AND IMAGE FORMING APPARATUS

(75) Inventor: Daisaku Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/962,820

(22) Filed: Dec. 8, 2010

(65) Prior Publication Data

US 2011/0074102 A1 Mar. 31, 2011

Related U.S. Application Data

(62) Division of application No. 12/389,530, filed on Feb. 20, 2009, now Pat. No. 7,896,338.

(30) Foreign Application Priority Data

Feb. 29, 2008 (JP) ..... 2008-048962
Feb. 13, 2009 (JP) ..... 2009-030601

(51) Int. Cl.
*B65H 29/00* (2006.01)

(52) U.S. Cl. ..... 271/220; 271/207

(58) Field of Classification Search ..... 271/220, 271/221, 223; 270/58.08, 58.12
See application file for complete search history.

(56) References Cited

U.S. PATENT DOCUMENTS 4,905,055 A * 2/1990 Higaki ..... 399/410
5,229,812 A * 7/1993 Toyama et al. ..... 355/50
5,478,062 A * 12/1995 Horiuchi et al. ..... 270/58.08
6,859,445 B1 * 2/2005 Moon et al. ..... 370/335
7,017,901 B2 * 3/2006 Shiraishi et al. ..... 271/220
7,021,616 B2 4/2006 Mizuta et al.
7,207,556 B2 * 4/2007 Saitoh et al. ..... 270/58.08
7,293,766 B2 * 11/2007 Ruthenberg et al. ..... 270/37
7,331,573 B2 2/2008 Mizuta et al.

(Continued)

FOREIGN PATENT DOCUMENTS

EP 0 820 948 A2 1/1998

(Continued)

OTHER PUBLICATIONS

European Search Report dated Dec. 28. 2011, in counterpart European Patent Application No. 09153859.5.

*Primary Examiner* — Kaitlin Joerger
(74) *Attorney, Agent, or Firm* — Fitzpatrick, Cella, Harper & Scinto

(57) ABSTRACT

To prevent deviation in a processing position of a sheet bundle caused by buckling of the sheet bundle and handle a number of diversified kinds of sheets without increasing the size of apparatuses, a sheet processing apparatus and a image forming apparatus includes a pair of saddle entrance rollers which discharges a sheet; a stack tray which stacks the sheet discharged by the roller pair; a gripping member which grips the rear end portion of the sheet in the discharging direction which is stacked by the tray; a gripper which grips the front end portion of the sheet in the discharging direction which is stacked by the tray; and a stapler, etc., which processes a sheet bundle at a processing position, wherein the gripping member and the gripper grip the sheet bundle stacked by the tray and move the sheet bundle to the processing position in cooperation with each other.

10 Claims, 19 Drawing Sheets

U.S. PATENT DOCUMENTS

| | | | | |
|---|---|---|---|---|
| 7,568,688 | B2 * | 8/2009 | Nomura et al. | 270/58.12 |
| 2006/0120784 | A1 * | 6/2006 | Iida et al. | 399/407 |
| 2007/0057427 | A1 | 3/2007 | Kamiya et al. | |
| 2007/0060459 | A1 * | 3/2007 | Hayashi | 493/434 |
| 2007/0145674 | A1 * | 6/2007 | Saito | 271/207 |
| 2007/0278732 | A1 * | 12/2007 | Kitahara | 270/58.08 |
| 2008/0063451 | A1 | 3/2008 | Kamiya et al. | |
| 2008/0099974 | A1 * | 5/2008 | Nomura et al. | 270/58.12 |
| 2009/0121420 | A1 | 5/2009 | Hayashi et al. | |
| 2009/0127772 | A1 * | 5/2009 | Kamiya | 271/220 |

FOREIGN PATENT DOCUMENTS

| | | | |
|---|---|---|---|
| EP | 0 960 744 | A2 | 12/1999 |

* cited by examiner

FIG. 13A

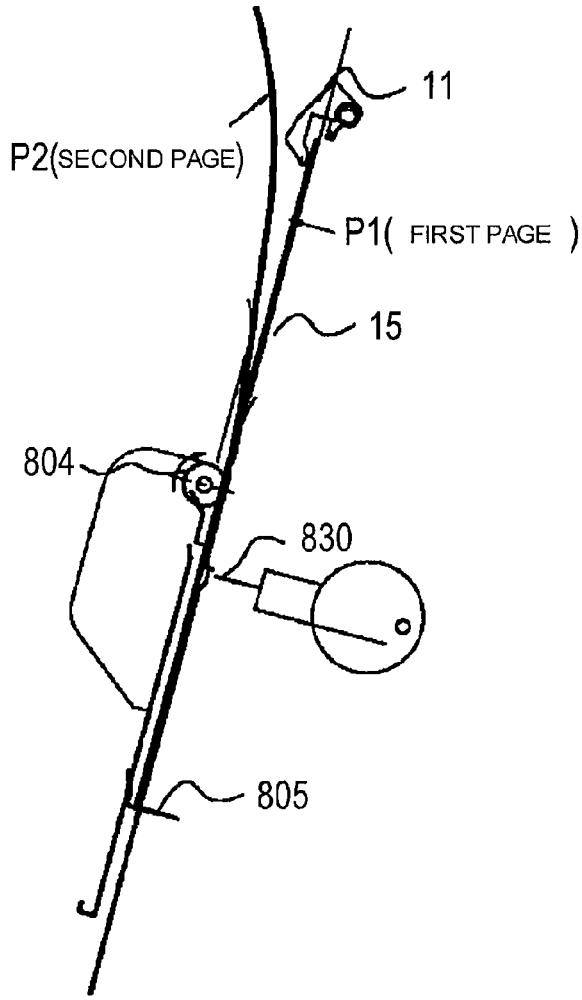

FIG. 13B

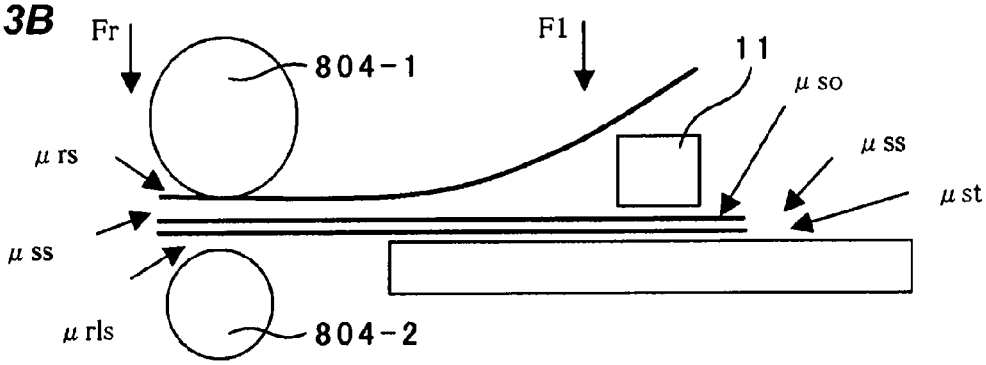

F1: GRIPPING FORCE OF GRIPPING MEMBER 11

Fr: GRIPPING FORCE OF CONVEYING ROLLER 804

μso: FRICTION COEFFICIENT BETWEEN GRIPPING MEMBER 11 AND SHEET

μst: FRICTION COEFFICIENT BETWEEN STACK TRAY 15 AND SHEET

μrs: FRICTION COEFFICIENT BETWEEN CONVEYING ROLLER 804 AND SHEET

μrls: FRICTION COEFFICIENT BETWEEN FOLLOWING ROLLER (COUNTER ROLLER 804-2 OF CONVEYING ROLLER 804-1) AND SHEET μss: FRICTION COEFFICIENT BETWEEN SHEETS FIG. 14D
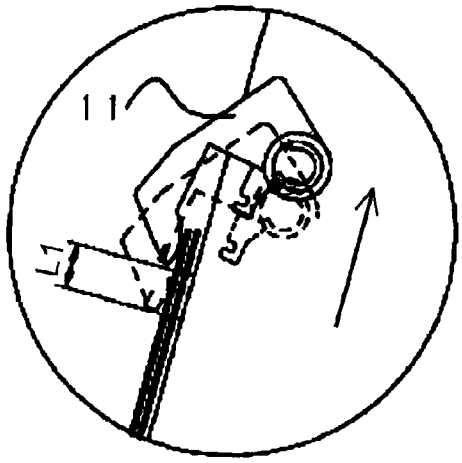
F1 (GRIPPING FORCE OF GRIPPING MEMBER 11) < F2 (GRIP FORCE OF FRONT END STOPPER)
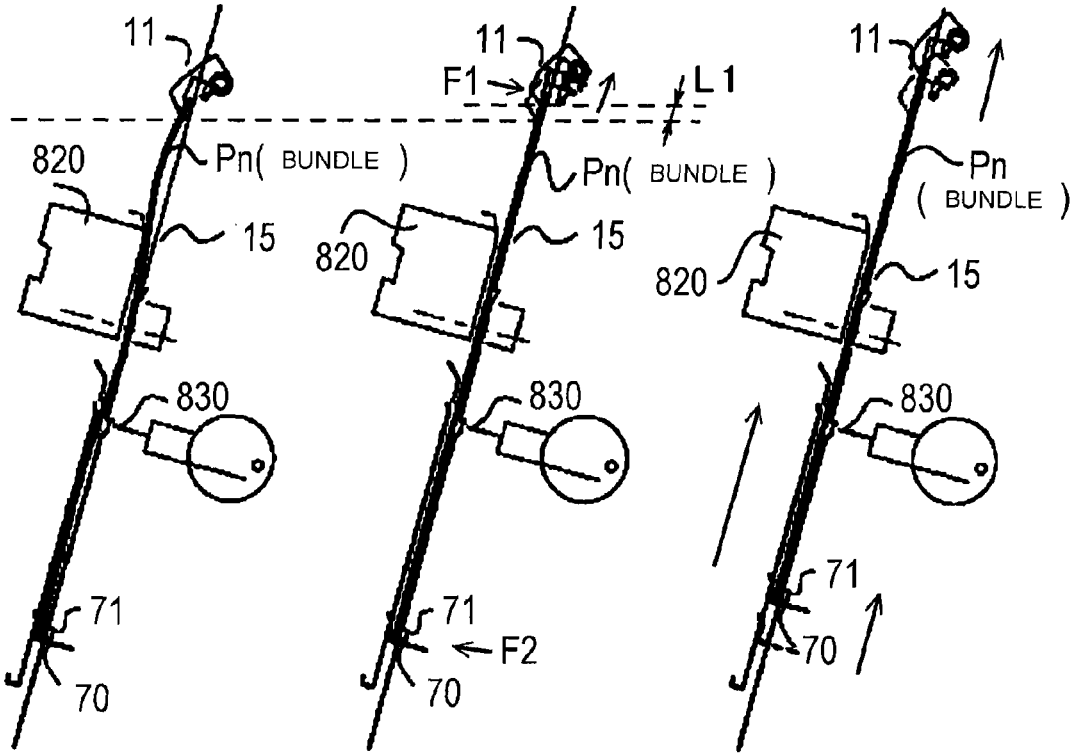
FIG. 14A FIG. 14B FIG. 14C FIG. 16D
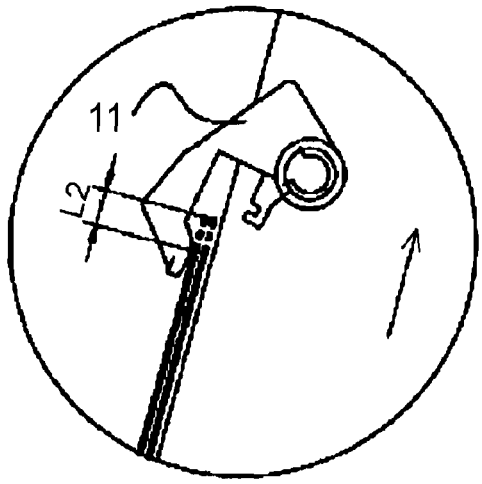
F1 (GRIPPING FORCE OF GRIPPING MEMBER 11) < F2 (GRIP FORCE OF FRONT END STOPPER)
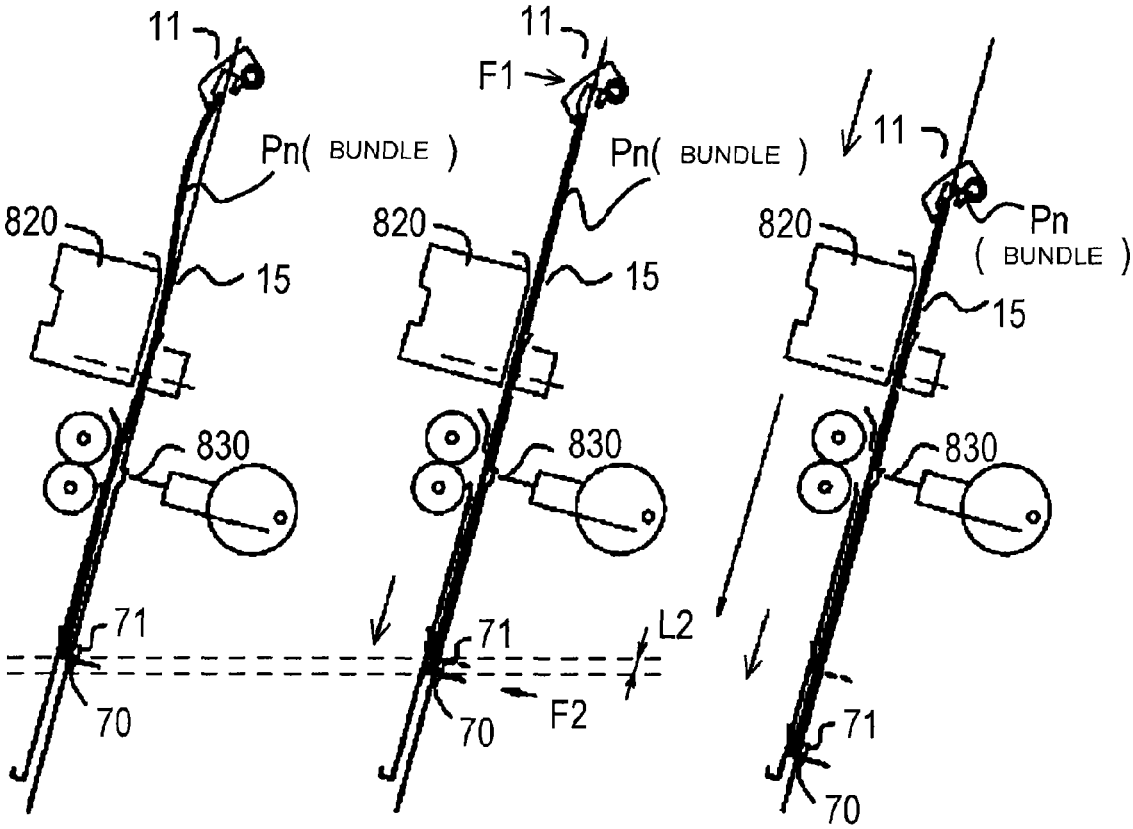
FIG. 16A FIG. 16B FIG. 16C

SHEET PROCESSING APPARATUS AND IMAGE FORMING APPARATUS

This is a division of U.S. patent application Ser. No. 12/389,530, filed Feb. 20, 2009.

BACKGROUND OF THE INVENTION

1. Field of the Invention

The present invention relates to a sheet processing apparatus capable of moving a sheet to a processing position and processing the sheet at the processing position, and to an image forming apparatus having the sheet processing apparatus.

2. Description of the Related Art

Some conventional image forming apparatuses which form an image on a sheet have a sheet processing apparatus which bundles sheets on which images are formed in an apparatus body, binds and folds the same into a booklet form. As such a sheet processing apparatus, an invention of US2007/0060459 is disclosed. According to the sheet processing apparatus described in US2007/0060459, sheets are sequentially received by a tray, the sheets are bound into a bundle and aligned, central portions of the sheets are bound, the central portions are pricked with an thrusting member and pushed into a nip of a pair of folding rollers, and the pair of folding rollers fold the sheet bundle while conveying the bundle.

The operation of the conventional sheet processing apparatus will be described using FIGS. 17 to 19. As illustrated in FIG. 17, the sheet processing apparatus first aligns a plurality of sheets by a collecting portion (accommodating guide) 803 as the tray and then, the sheet processing apparatus binds the central portions of the sheets in the conveying direction with a staple. Next, the central portion of the sheet bundle is pricked with a folding plate (thrusting) member 830 as the thrusting member, and the central portion is pushed into a nip between a pair of first folding rollers 810*a* and 810*b*. The sheet bundle is fold by the pair of folding rollers 810*a* and 810*b*, then the sheet bundle is conveyed a pair of first folded sheet conveying rollers 811*a* and 811*b*, and a pair of second folded sheet conveying rollers 812*a* and 812*b*, and the sheet bundle is stopped.

The folded portion is nipped by the pair of first folded sheet conveying rollers 811*a* and 811*b*, and the pair of second folded sheet conveying rollers 812*a* and 812*b*, a press rollers are moved along the crease of the sheets (in a direction orthogonal to the conveying direction), thereby reinforcing the folded portion. With this, the sheet bundle is folded from center, and a center-folded sheet bundle (simply referred to as a "folded sheet bundle", hereinafter) is completed. Then, the sheet bundle is conveyed and discharged into a folded bundle discharge tray 840.

In recent years, sheets are diversified, and image quality level of the image forming apparatus is enhanced. For example, it is possible to print on a paper sheet such as a special sheet whose surface is processed such as a coated paper, or a paper sheet having a wide range of grammage to which the sheet is adapted (thin weak paper or thick firm paper).

However, as illustrated in FIG. 18, when weak sheets are stacked on an inclined tray or when the stacked sheets are moved, the following problems may occur. When a sheet bundle is moved to a binding position (processing position) of a stapler 820 located above the stacking position, if the sheet bundle is lifted only by a sheet receiving member 805, the weight of the sheet bundle may not be supported and the sheet bundle is buckled. As a result, the binding position of a staple is deviated by the buckled amount as illustrated in FIG. 19.

Especially in an upright path aligning structure which aligns sheets at a substantially vertical sheet stacking portion, the above circumstance is significant. As a solution, the sheet stacking portion may be disposed substantially horizontally so that the sheets are not affected by the own weight, but this causes the apparatus to be increased in size in the lateral direction and as a result, the installation area of the apparatus is increased.

SUMMARY OF THE INVENTION

It is an object of the present invention to provide a sheet processing apparatus and an image forming apparatus which prevent deviation in a processing position of a sheet bundle caused by buckling of the sheet bundle, and which is capable of handling a number of diversified kinds of sheets, without increasing the size of the apparatuses.

To achieve the above and other objects, the present invention provides a sheet processing apparatus and an image forming apparatus including: a sheet discharge portion which discharges a sheet; a sheet stacking portion which have an inclined sheet stacking surface on which the sheet discharged by the sheet discharge portion is stacked; first and second gripping members which each grip the sheet at two positions being away from each other in a direction along the inclination of the sheet stacking surface, and are movable in the direction along the inclination of the sheet stacking surface; a sheet processing portion which processes the sheet; and a controlling portion which controls the movement of the first and the second gripping members so as to adjust a position of the sheet gripped by the first and the second gripping members corresponding to the sheet processing portion in the direction along the inclination of the sheet stacking surface.

According to the present invention, it is possible to provide a sheet processing apparatus and an image forming apparatus which prevent deviation in a processing position of a sheet bundle caused by buckling of the sheet bundle, and capable of handling a number of diversified kinds of sheets, without increasing the size of the apparatuses.

Further features of the present invention will become apparent from the following description of exemplary embodiments with reference to the attached drawings.

BRIEF DESCRIPTION OF THE DRAWINGS

FIGS. 13A and 13B are explanatory diagrams illustrating a relation between a gripping force of the gripping member and a friction coefficient;

FIGS. 14A to 14D are diagrams of procedures illustrating driving operations of the gripping member and the sheet receiving member and a sheet conveying operation;

FIGS. 16A to 16D are diagrams of procedures illustrating driving operations of a gripping member and a sheet receiving member in a saddle stitch binding portion, and a sheet conveying operation according to a second embodiment of the invention;

DESCRIPTION OF THE EMBODIMENTS

Preferred embodiments of the present invention will exemplarily be described in detail with reference to the drawings. Sizes, materials, shapes and relative positions of constituent parts described in the following embodiments should appropriately be modified depending upon a structure of an apparatus to which the invention is applied and depending upon various conditions. Therefore, the scope of the invention should not be limited to those unless otherwise specifically described.

First Embodiment

Figure 1:
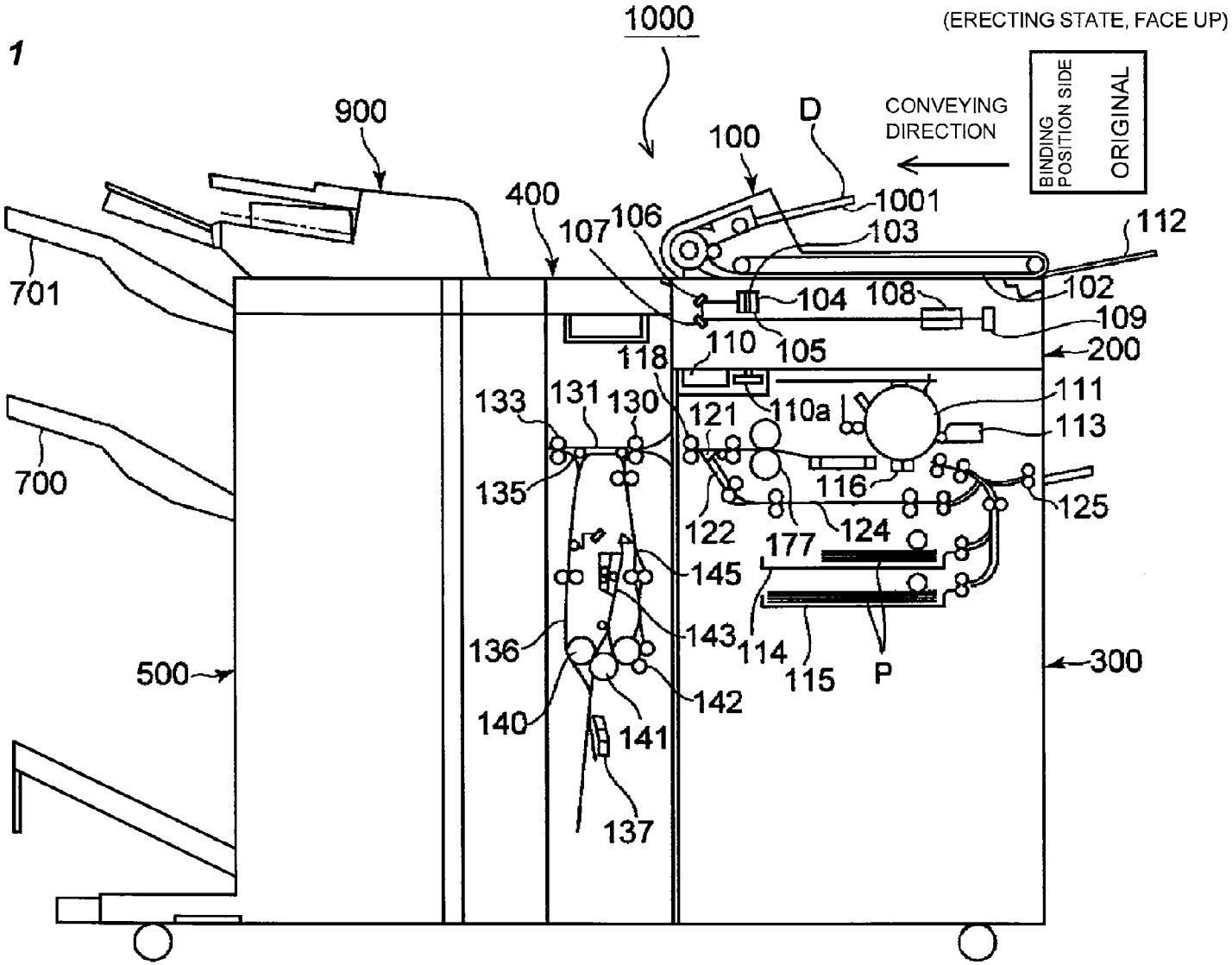
FIG. 1 is a sectional view of a copying machine having a saddle stitch binding portion according to a first embodiment of the present invention.

FIG. 1 is a sectional view of a copying machine 1000 as an image forming apparatus having a sheet processing apparatus according to a first embodiment. Numeric values described in the embodiment are merely reference numeric values, and the invention is not limited to these numeric values.

The copying machine 1000 which is one example of the image forming apparatus includes an original supply portion 100, an image reader portion 200, a printer portion 300, a folding processing portion 400, a finisher 500 as a sheet processing apparatus, and an inserter 900. The folding processing portion 400 and the inserter 900 can be provided as options. The finisher 500 which is the sheet processing apparatus includes a later-described saddle stitch binding portion.

Originals D are set on a tray 1001 of the original supply portion 100 in a face-up state (a surface on which an image is formed faces upward). A binding position of the original D is a left end of the original D. The originals D set on the tray 1001 are conveyed leftward from the top page by the original supply portion 100 one sheet by one sheet such that the binding position is set to the leading position. The original D passes through a curved path, is conveyed from left to right on a platen glass 102 and then, is discharged onto a discharge tray 112. At this time, a scanner unit 104 is stopped at a predetermined reading position.

The scanner unit 104 reads an image of the original D which passes on the scanner unit 104 from left to right. Such a method of reading the original D is called a "running reading method". When the original D passes on the platen glass 102, the original D is irradiated with light by a lamp 103 of the scanner unit 104. Reflection light from the original D is guided into an image sensor 109 through mirrors 105, 106 and 107 and a lens 108.

The image reader portion 200 can also stop the original D once on the platen glass 102 by the original supply portion 100, and move the scanner unit 104 from left to right in this state to carry out the reading processing of the original D. This reading method is called a "fixed reading method". When an original D is read without using the original supply portion 100, a user opens and closes the original supply portion 100 and sets the original D on the platen glass 102. Then, the scanner unit 104 carried out the fixed reading of the original D.

Image data of the original D read by the image sensor 109 is subjected to predetermined image processing, and is sent to an exposure controlling portion 110. The exposure controlling portion 110 outputs laser light corresponding to an image signal. The laser light is scanned by a polygon mirror 110*a* and emitted on a photoconductive drum 111. An electrostatic latent image corresponding to the scanned laser light is formed on the photoconductive drum 111.

The electrostatic latent image formed on the photoconductive drum 111 is developed by a developing device 113, and is visualized as a toner image. A sheet P such as a recording paper sheet is conveyed to a transfer portion 116 from any of cassettes 114 and 115, a manual paper supply portion 125 and a duplex conveying path 124. The visualized toner image is transferred to the sheet in the transfer portion 116. On the sheet onto which the image was transferred, the toner image is fixed by a fixing portion 177. The photoconductive drum 111 and the developing device 113 constitute an image forming portion.

A sheet P which passed through the fixing portion 177 is once guided to a path 122 by a switching member 121. When the rear end of the sheet passes through the switching member 121, the sheet is switched back and conveyed, and is guided to discharge rollers 118 by the switching member 121. The sheet is discharged from the printer portion 300 by discharge rollers 118. Accordingly, the sheet is discharged from the printer portion 300 in a state where a surface thereof on which the toner image is formed faces downward (face down). This operation is called a "reverse discharge".

If the sheets are discharged from the apparatus in the face down state, the image forming processing can be carried out sequentially from the top page. For example, when image forming processing is carried out using the original supply portion 100 or when image forming processing on image data from a computer 204 (FIG. 10) is carried out, pages can be arranged in order.

When images are formed on both surfaces of a sheet, the printer portion 300 guides the sheet to the discharge rollers 118 straightly from the fixing portion 177. Immediately after the rear end of the sheet passes through the switching member 121, the printer portion 300 switches back and conveys the sheet and guides the sheet to the duplex conveying path 124 by the switching member 121.

Figure 2:
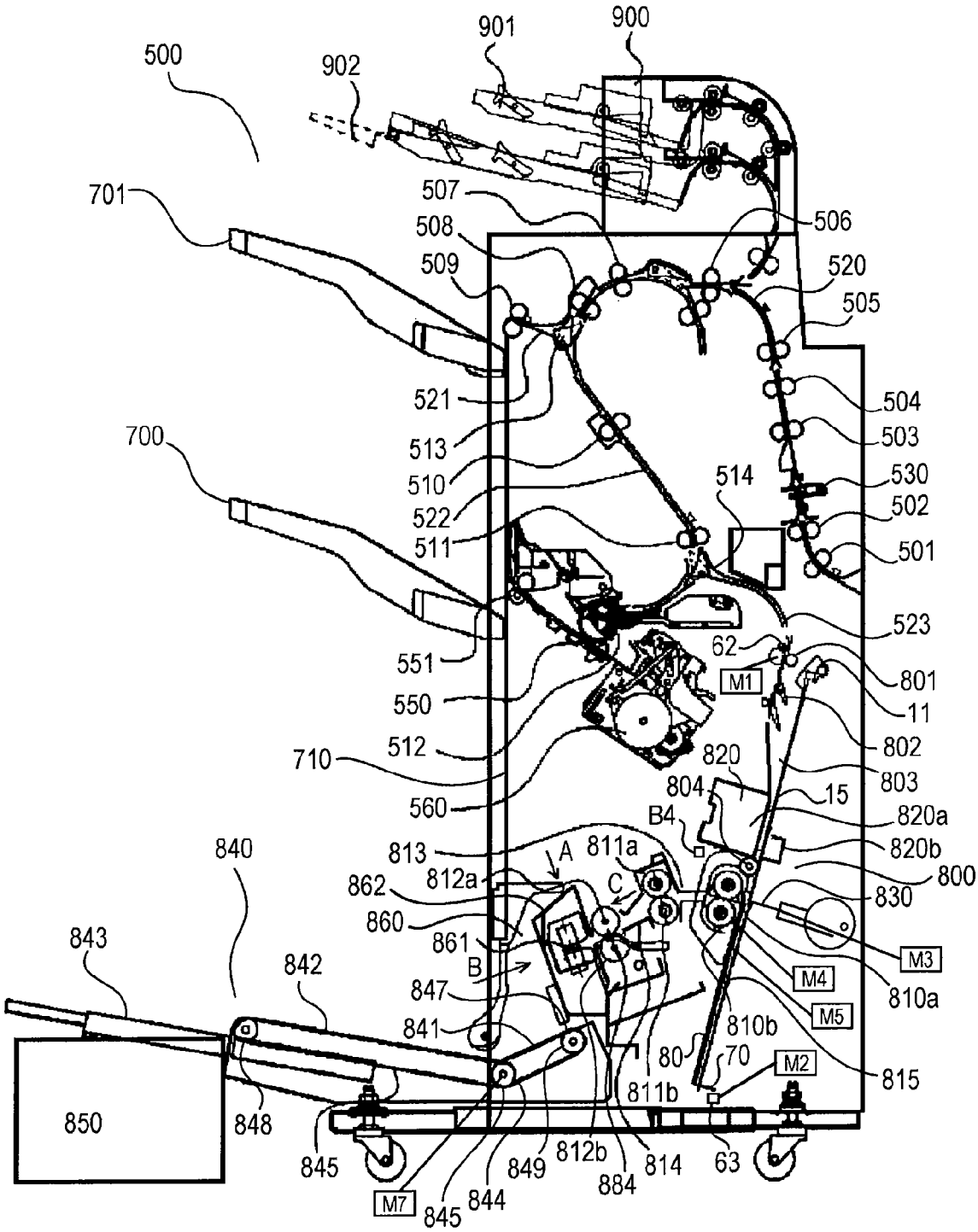
FIG. 2 is a sectional view illustrating a structure in a finisher.

Next, structures of the folding processing portion 400 and the finisher 500 will be described based on FIGS. 1 and 2. FIG. 2 is a sectional view illustrating an internal structure of the finisher 500.

In FIG. 1, the folding processing portion 400 includes a conveying path 131 which receives a sheet discharged from the printer portion 300 and guides the sheet toward the finisher 500. The conveying path 131 is provided with a pair of conveying rollers 130 and a pair of discharge rollers 133. A switching member 135 is provided near the pair of discharge rollers 133. The switching member 135 guides a sheet conveyed by the pair of conveying rollers 130 toward the folding path 136 or the finisher 500.

When folding processing of sheets is carried out, the switching member 135 is switched to the folding path 136 to guide a sheet to the folding path 136. The sheet guided to the folding path 136 is conveyed to folding rollers 140 and 141, and folded into a Z-shape.

When the folding processing is not carried out, the switching member 135 is switched to guide a sheet to the finisher 500. The sheet discharged from the printer portion 300 passes through the conveying path 131 and the switching member 135 and is sent directly to the finisher 500.

The front end of a sheet conveyed to the folding path 136 is pushed against a stopper 137 to form a loop which is folded by the folding rollers 140 and 141. This folded portion is pushed against an upper stopper 143 to form a loop which is further folded by folding rollers 141 and 142, and consequently, the sheet is folded into a Z-shape. The sheet which is folded into a Z-shape is guided to the conveying paths 145 and 131, and is discharged to the finisher 500 by the pair of discharge rollers 133. The folding processing by the folding processing portion 400 is carried out selectively.

The finisher 500 aligns a plurality of sheets conveyed from the printer portion 300 through the folding processing portion 400. The finisher 500 selectively carries out sheet processing such as processing for binding sheets in one sheet bundle, staple processing (binding processing) for stapling the rear end of the sheet bundle, sorting processing and non-sorting processing.

As illustrated in FIG. 2, the finisher 500 includes a conveying path 520 which takes a sheet conveyed through the folding processing portion 400 (see FIG. 1) into the finisher 500. The conveying path 520 is provided with pairs of conveying rollers 502 to 508 in this order from a pair of entrance rollers 501 toward the downstream of the sheet conveying direction.

A punch unit 530 is provided between the pair of conveying rollers 502 and the pair of conveying rollers 503. The punch unit 530 operates as need arises, and punches a hole in the rear end of a conveyed sheet (punching processing).

A switching member 513 is provided at a terminal end of the conveying path 520. The switching member 513 switches the paths between an upper discharge path 521 and a lower discharge path 522 connected to a downstream portion. The upper discharge path 521 guides a sheet to a sample tray 701 by upper discharge rollers 509. The lower discharge path 522 is provided with pairs of conveying rollers 510, 511 and 512. The pairs of conveying rollers 510, 511 and 512 convey a sheet to a processing tray 550 where the sheet is discharged.

Sheets discharged into the processing tray 550 are sequentially subjected to aligning processing and stacked into a bundle. The bundle is subjected to processing such as sorting processing and stapling processing according to settings by an operation portion 1 (see FIG. 10). The processed sheet bundle is selectively discharged into a stack tray 700 or the sample tray 701 by a pair of bundle discharge rollers 551.

The staple processing is carried out by a stapler 560. The stapler 560 moves in a widthwise direction of a sheet (in a direction orthogonal to the sheet conveying direction) and binds an optional portion of the sheet bundle. The stack tray 700 and the sample tray 701 are lifted and lowered along a body 500A of the finisher 500. The upper sample tray 701 receives a sheet from the upper discharge path 521 and the processing tray 550. The lower stack tray 700 receives a sheet from the processing tray 550. A large amount of sheets can be stacked on the stack tray 700 and the sample tray 701. Rear ends of the stacked sheets are received by a rear end guide 710 which extends in the vertical direction and the sheets are aligned.

Next, a structure of a saddle stitch binding portion 800 included in the finisher 500 will be described. As illustrated in FIG. 2, the saddle stitch binding portion 800 is provided in the finisher 500. In the following description, processing for folding a sheet bundle by a pair of folding rollers 810 and an thrusting member 830 which constitute a sheet processing portion is called "folding processing". Further, processing for creasing the folded sheet bundle by a pair of press rollers 861 is called "creasing processing".

A switching member 514 provided on the lower discharge path 522 switches a sheet to the right to guide the same to a saddle discharge path 523, and then to the saddle stitch binding portion 800.

From an entrance of the saddle stitch binding portion 800, a pair of saddle entrance rollers 801, a switching member 802 which is operated by a solenoid according to the size, an accommodating guide (collecting portion) 803 which accommodates sheets, a conveying roller 804 and a sheet receiving member 70 are disposed in this order as a sheet discharge portion.

A gripping member 11 as a first gripping member is provided above the substantially vertical accommodating guide 803 (75° with respect to a horizontal plane in the drawing). The gripping member 11 grips rear end portions (upper end portions) of stacked sheets in a direction along the inclination of the sheet stacking surface 15*a*.

The pair of saddle entrance rollers 801 and the conveying roller 804 are rotated by a conveying motor M1. The conveying roller 804 is supported such that the conveying roller 804 can come into contact with and separate from a sheet by a driving source (not illustrated), and the conveying roller 804 can come into contact and separate at predetermined timing. The stapler 820 as a sheet processing portion is provided on the accommodating guide 803. Parts 820*a* and 820*b* of the stapler 820 are opposed to each other with the accommodating guide 803 interposed therebetween. The stapler 820 includes a driver 820*a* which drives out a staple, and an anvil 820*b* which bends the projected staple. The stapler 820 as a sheet processing portion carries out binding processing on a sheet bundle at a binding position as a processing position.

Figure 3:
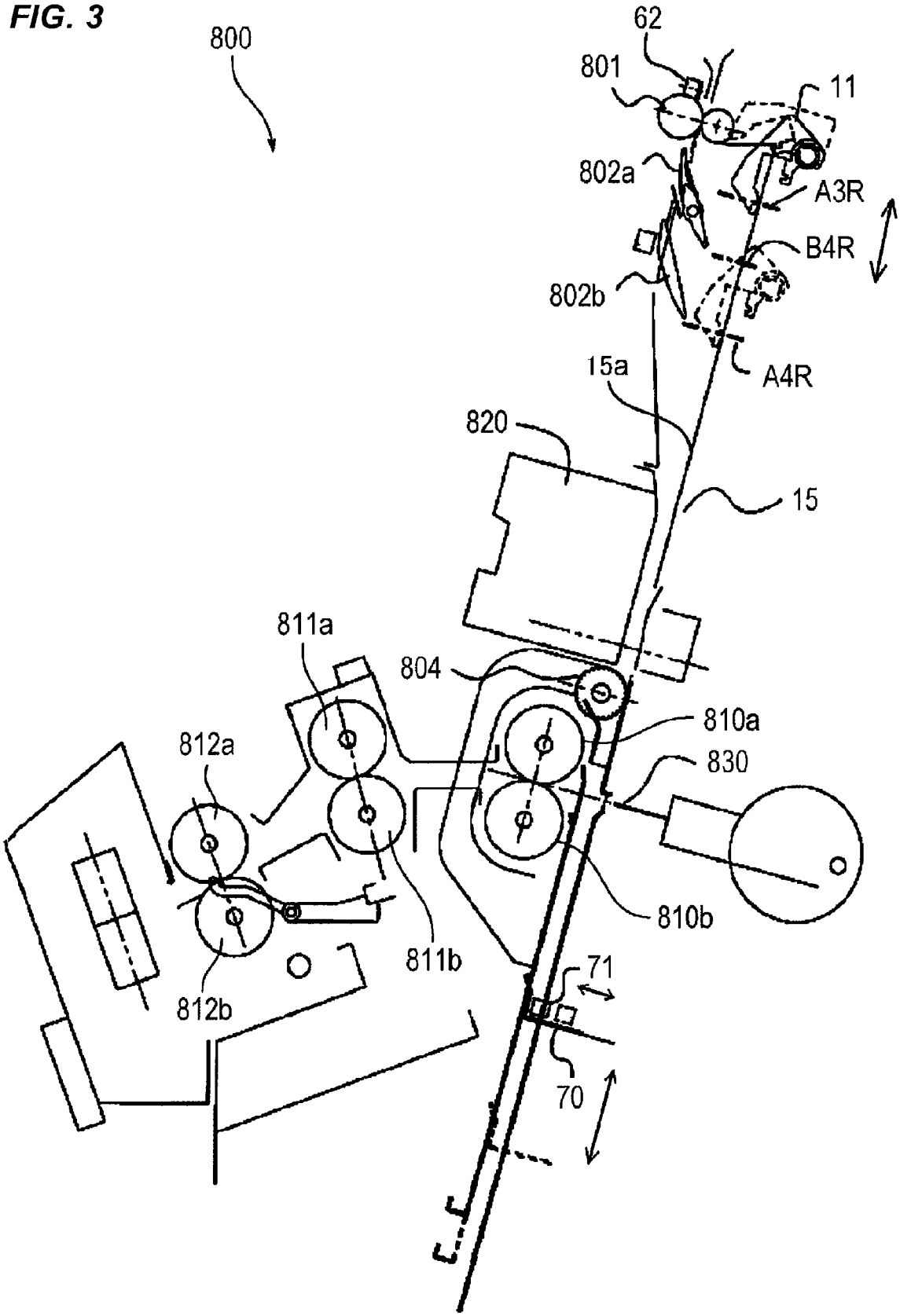
FIG. 3 is a sectional view illustrating a structure of a sheet processing apparatus.

The sheet receiving member 70 will be described using FIGS. 3 and 4. FIG. 3 is a sectional view illustrating a structure of the saddle stitch binding portion 800. As illustrated in FIG. 3, the saddle stitch binding portion 800 includes a stack tray 15 which is a sheet stacking portion, the sheet receiving member 70, the gripping member 11 which is the first gripping member and a gripper 71 which is a second gripping member. The stack tray 15 have an inclined sheet stacking surface 15*a*. The sheet stacking surface 15*a* of the stack tray 15 is inclined with respect to a horizontal plane by a predetermined angle (75° with respect to the horizontal plane). After the sheet is discharged by the pair of saddle entrance rollers 801, the sheet is stacked on the inclined sheet stacking surface 15*a*. Each the gripping member 11 and the gripper 71 grip the sheet at two positions being away from each other in the direction along the inclination of the sheet stacking surface 15*a*. Each the gripping member 11 and the gripper 71 are movable in the direction along the inclination of the sheet stacking surface 15*a* respectively. The direction along the inclination can be called "an angle of inclination". The sheet receiving member 70 which receives one end of a sheet in the discharging direction is mounted on the stack tray 15 such that the sheet receiving member 70 can move in a direction along the sheet stacking surface 15*a* of the stack tray 15. The sheet receiving member 70 functions as a front end stopper which receives sheets, and stops a falling sheet at the front end (lower end) thereof in the discharging direction.

The gripping member 11 which is the first gripping member is mounted on the stack tray 15. The gripping member 11 grips the rear end portion (upper end portion) as a first position of a sheet in the direction along the inclination of the sheet stacking surface 15*a* (in the discharging direction). The gripper 71 which is the second gripping member for gripping the front end portion (lower end portion) as a second position of a sheet in the direction along the inclination of the sheet stacking surface 15*a* (in the discharging direction) is mounted on the sheet receiving member 70. As illustrated with solid lines and broken lines in FIG. 3, the sheet receiving member 70 can operate in a direction along the stack tray 15.

Figure 4:
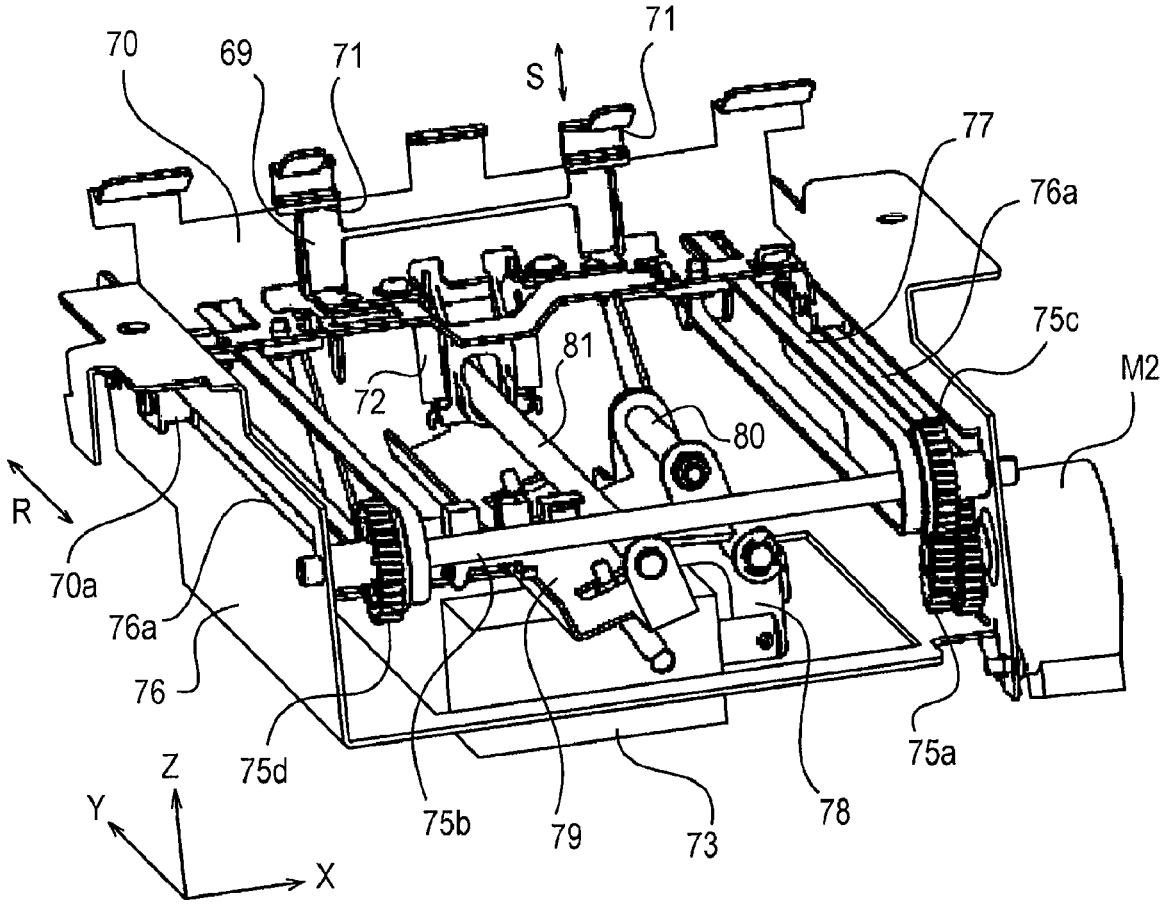
FIG. 4 is a perspective view illustrating a portion of a structure of the saddle stitch binding portion and especially illustrating a structure near a sheet receiving member.

FIG. 4 is a perspective view illustrating a part of the structure of the saddle stitch binding portion 800, and illustrating in particular a structure thereof near the sheet receiving member 70. The saddle stitch binding portion 800 includes a support frame 76 mounted on the stack tray 15, and the sheet receiving member 70 which can move with respect to the support frame 76 and receive a sheet. As illustrated in FIG. 4, long holes 76*a* are formed at two locations in the support frame 76 in a direction along the sheet stacking surface 15*a* of the stack tray 15 (Y axial direction). Projections 70*a* are formed at both ends of the sheet receiving member 70 in the X axial direction. The projections 70*a* at two locations are inserted into the long holes 76*a* at two locations. The sheet receiving member 70 is supported by the support frame 76 such that the sheet receiving member 70 can slide in a direction illustrated with the arrow R along the Y axis.

A sheet receiving member moving motor M2 is mounted on the support frame 76, and a rotation shaft of the sheet receiving member moving motor M2 is oriented in the X axial direction. A drive gear 75*a* is mounted on the rotation shaft of the sheet receiving member moving motor M2. A shaft 75*b* is mounted in parallel to the rotation shaft of the sheet receiving member moving motor M2 such that the shaft 75*b* can rotate with respect to the support frame 76. A drive gear 75*c* is mounted on one end of the shaft 75*b*, and a drive gear 75*d* is mounted on the other end of the shaft 75*b*. Teeth of the drive gear 75*a* mesh with the drive gear 75*c*. A timing belt 77 is wound around the shaft 75*b*. A part of the sheet receiving member 70 is fixed to the timing belt 77.

According to this structure, a driving force of the sheet receiving member moving motor M2 is transmitted to the timing belt 77 through the drive gears 75*a*, 75*c* and 75*d* and the shaft 75*b*. The sheet receiving member 70 can slide with respect to the support frame 76 as illustrated with the arrow R. Therefore, the sheet receiving member 70 moves in a direction along the sheet stacking surface 15*a* of the stack tray 15 (see FIG. 3).

As illustrated in FIG. 4, a gripper portion 69 having the gripper 71 is mounted on the sheet receiving member 70. The gripper 71 as the second gripping member grips a sheet and a sheet bundle. The gripper portion 69 can slide in a direction (Z axial direction) illustrated with the arrow S which is orthogonal to the sheet stacking surface 15*a* of the stack tray 15. The gripper 71 grips and retracts by a solenoid 73, links 78 and 79 and a spring 72 fixed to the support frame 76. The direction extending along the plate surface of the sheet receiving member 70 may be inclined by a predetermined angle with respect to the XY plane. A sheet stopping portion 70*b* is formed on an end of the sheet receiving member 70 on the side of the stack tray 15.

When the solenoid 73 is turned ON, the link 78 rotates. At the same time, the link 79 which is engaged with the link 78 rotates around a shaft 80. A shaft 81 which is engaged with the gripper portion 69 is fixed to the link 79. With this, when the link 79 rotates and moves upward in FIG. 4, the gripper portion 69 moves upward in FIG. 4 by an extension spring 72. As a result, the gripper 71 and the sheet receiving member 70 can nip a sheet (grip setting state).

When the solenoid 73 is turned OFF, the link 79 is rotated by a spring (not illustrated) so that the shaft 81 is moved downward in FIG. 4. The gripper portion 69 which is engaged with the link 79 moves downward in FIG. 4. As a result, the sheet gripping force of the gripper 71 is released (grip release state).

As illustrated in FIG. 3, when a sheet is conveyed onto a stack tray 15, the sheet receiving member 70 receives the front end (lower end) of the sheet and at the same time, the sheet receiving member 70 is lifted or lowered to adjust a position thereof such that the central portion of the sheet in the conveying direction comes to a binding position of the stapler 820. Normally, the sheet receiving member 70 is lifted or lowered by the sheet receiving member moving motor M2 and stops at a position corresponding to the size of the sheet. However, depending upon the size of a conveyed sheet, the sheet may be received at a position where the rear end (upper end) of the sheet comes out of switching members 802*a* and 802*b*. In such a case, the gripper 71 grips a sheet or a sheet bundle after the stacking operation of a sheet onto the stack tray 15 is completed. The sheet receiving member 70 is moved upward or downward in a direction along the sheet stacking surface 15*a* of the stack tray 15 such that the central portion of a sheet in the conveying direction comes to the binding position (processing position) of the stapler 820. Then, the sheet bundle is stapled.

As illustrated in FIG. 3, the position of the rear end (upper end) of a sheet which is pushed against the sheet receiving member 70 and is aligned is varied depending upon the size of the sheet. Therefore, the gripping member 11 is adapted to move in the vertical direction (conveying direction) as illustrated in FIG. 3. With this structure, the gripping member 11 can also grip the rear end portions (upper end portions) of sheets of different sizes.

Figure 5:
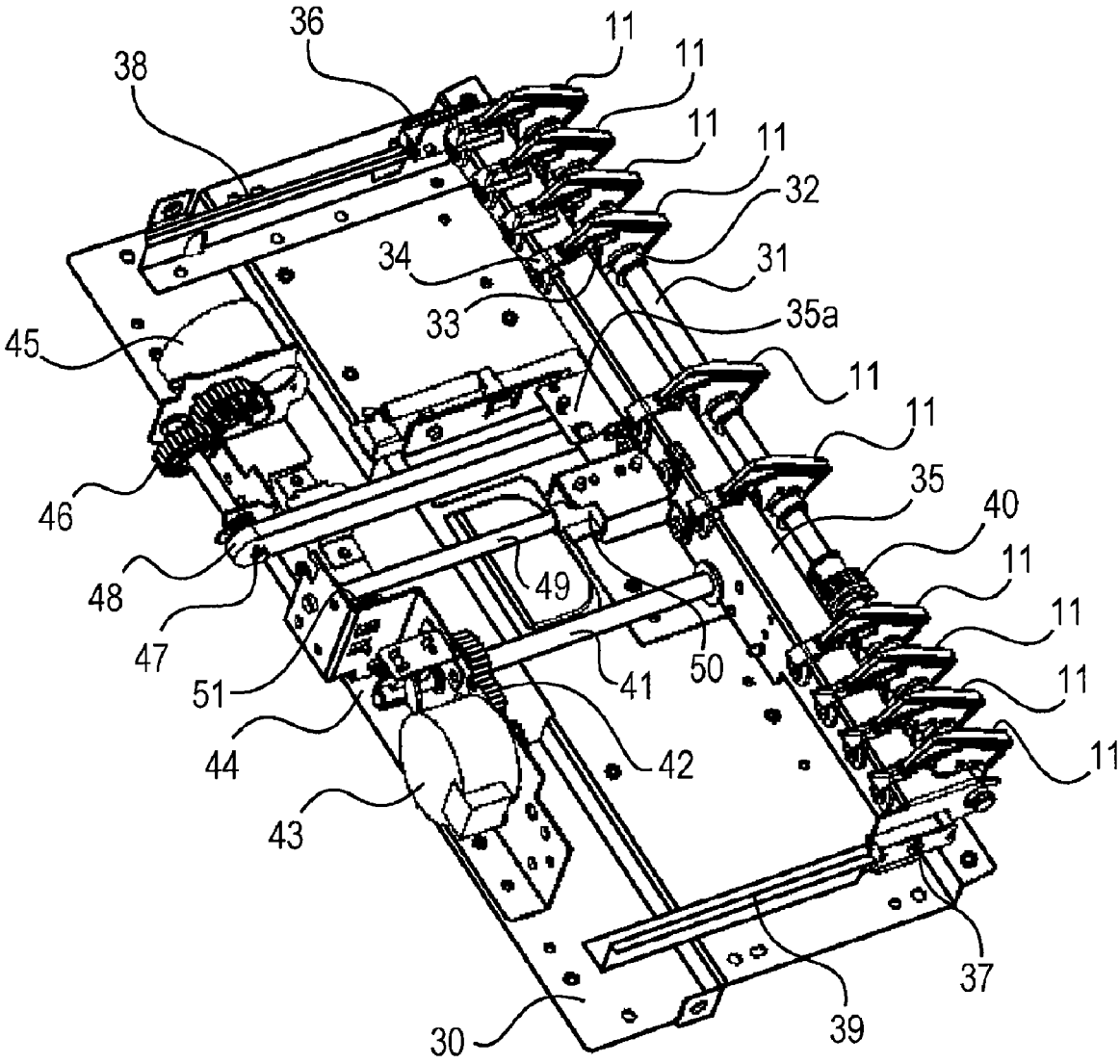
FIG. 5 is a perspective view illustrating a portion of a structure of the saddle stitch binding portion and especially illustrating a structure near a gripping member.

FIG. 5 is a perspective view illustrating a portion of a structure of the saddle stitch binding portion 800, especially a structure thereof near the gripping member 11. A support member 35 is movably mounted on a frame 30. A gripping shaft 31 which is a part of the first gripping member is rotatably supported on the support member 35. A holding member 32 which is a part of the first gripping member is fixed to the gripping shaft 31.

Figure 6A:
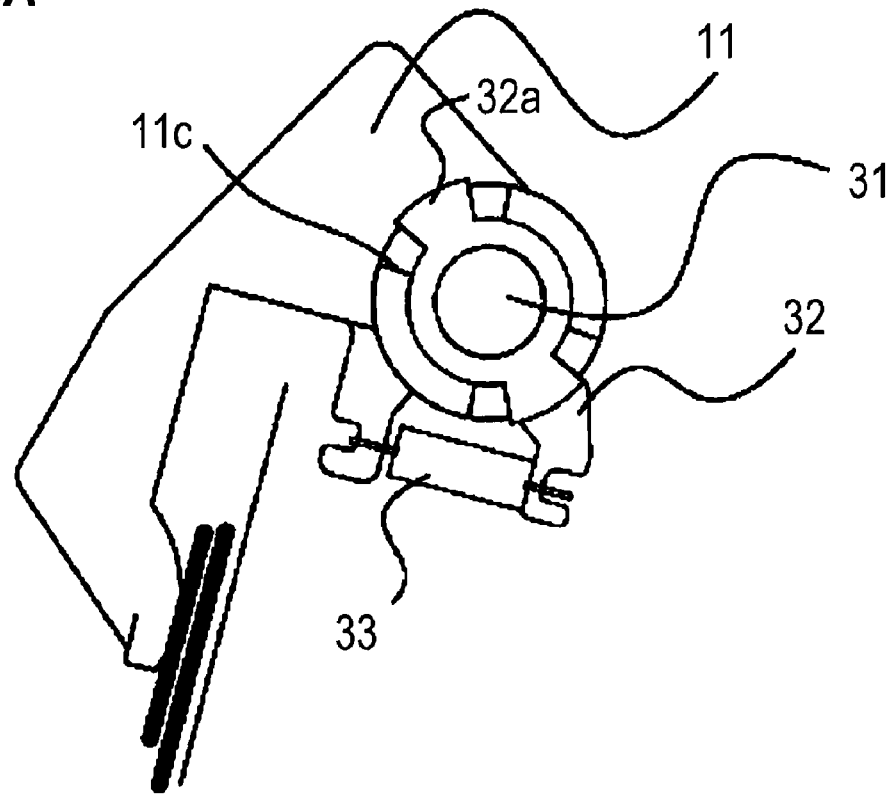
FIGS. 6A and 6B are enlarged views of a part near the gripping member.
Figure 6B:
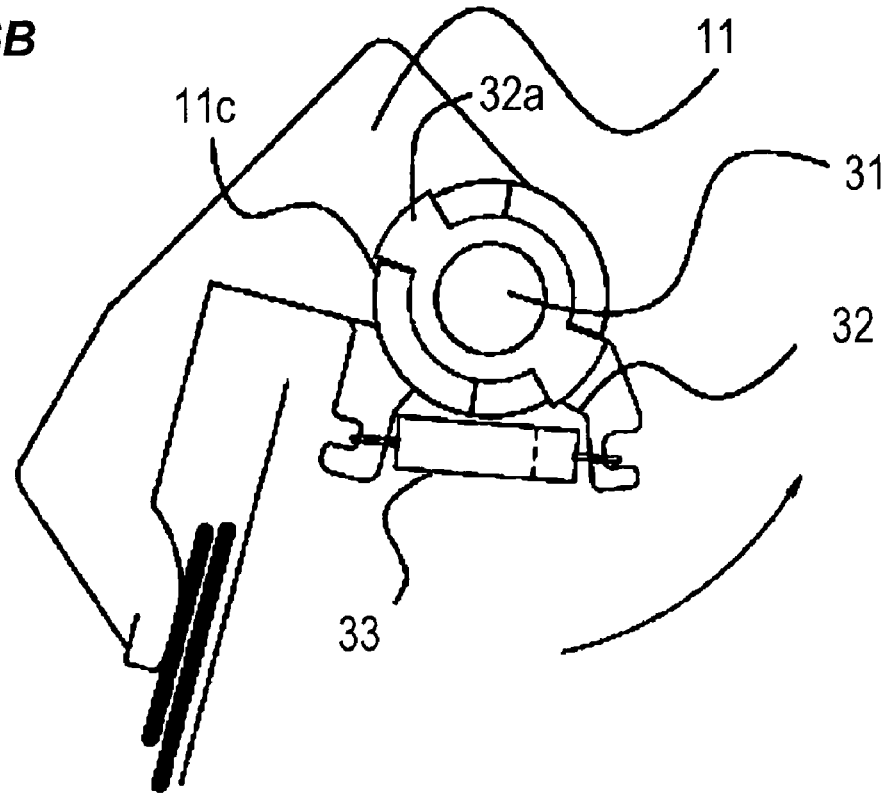

FIGS. 6A and 6B are enlarged views near the gripping member 11. As illustrated in FIGS. 6A and 6B, an engaging portion 32*a* of the holding member 32 and an engaging portion 11*c* of the gripping member 11 which is engaged with the engaging portion 32*a* have a predetermined backlash in a rotation direction of the gripping shaft 31. The gripping member 11 and the gripping shaft 31 are rotatably supported. The gripping member 11 is spring-biased by a pressing spring 33 whose one end is supported by the holding member 32.

As illustrated in FIG. 5, a drive portion 40 is disposed on the support member 35 to rotate and drive the gripping shaft 31, and a drive force is transmitted through a drive shaft 41. The drive force is generated by operation of a gripping member rotating motor 43. The gripping member rotating motor 43 rotates the gripping member 11 and the gripping shaft 31, gives a drive force to a drive gear portion 42 and rotates and drives the drive shaft 41. A gripping member position sensor 44 which is a sensor portion detects a rotation angle of the drive shaft 41, and detects a rotation position of the gripping member 11. The gripping member position sensor 44 is used for controlling the position of the gripping member 11 which is rotated by the gripping member rotating motor 43.

Figure 7A:
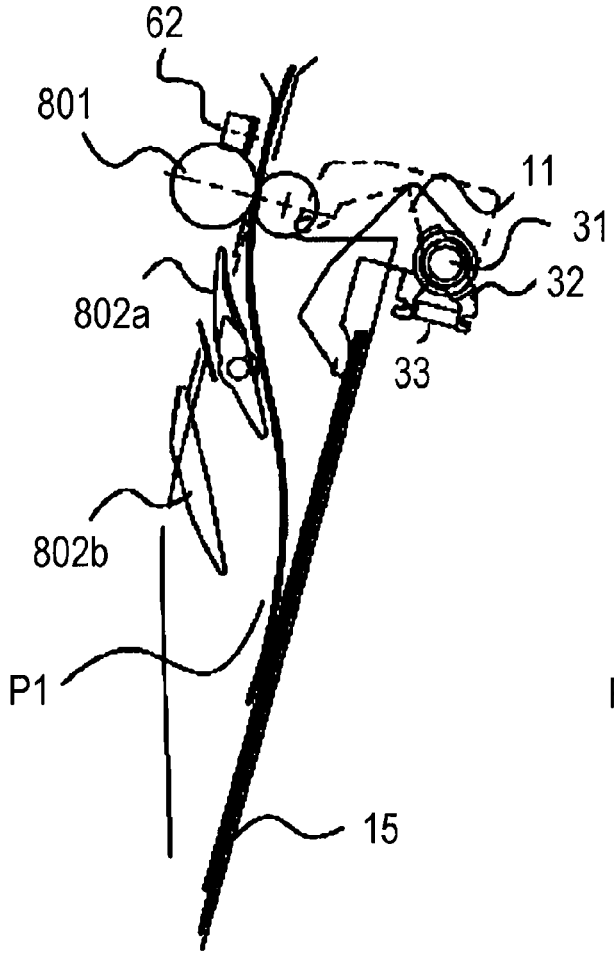
FIGS. 7A and 7B are enlarged views illustrating operation of the gripping member.
Figure 7B:
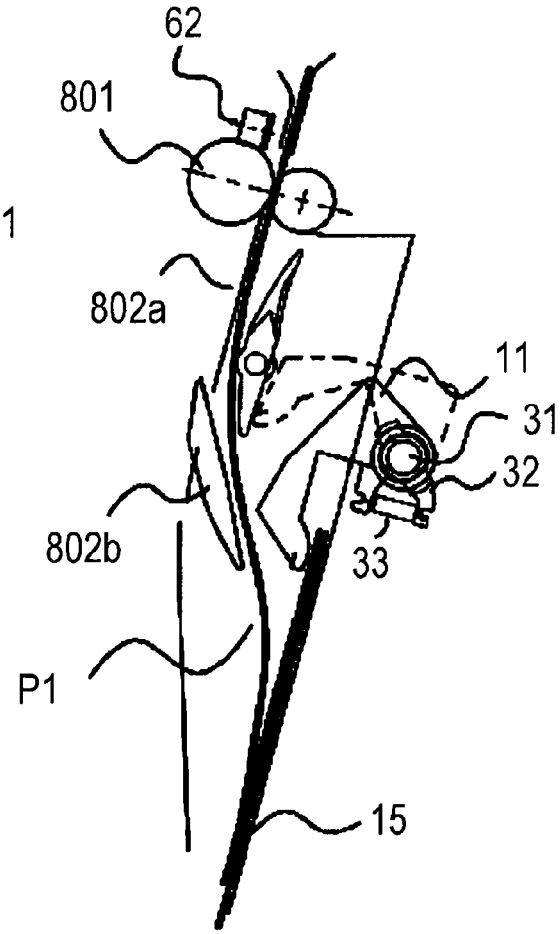

FIGS. 7A and 7B are enlarged views illustrating the operation of the gripping member 11. As illustrated in FIGS. 7A and 7B, the gripping member 11 can move to a sheet gripping position (solid lines in FIGS. 7A and 7B) and a sheet retracted position (broken lines in FIGS. 7A and 7B) by the structure described above. At the sheet pressing position, a gripping force is applied to a sheet by a spring force of the pressing spring 33. The gripping force of the gripping member 11 can be varied by controlling positions of the gripping shaft 31 and the holding member 32 by controlling the amount of rotation of the gripping member rotating motor 43 (see FIG. 5). For example, if the rotation amount is increased from the state in FIG. 6A as illustrated in FIG. 6B, the gripping force can be increased.

As illustrated in FIG. 5, the support member 35 is supported such that the support member 35 can slide and move with respect to a moving shaft 49 with a slide bush 50 fixed to the support member 35 therebetween. Slide rails 38 and 39 are fixed to both edge sides of the frame 30 in the X axial direction. Slide bushes 36 and 37 fixed to the support member 35 are slidably mounted on the slide rails 38 and 39.

A timing belt 48 is mounted on a substantially central portion of the frame 30. The longitudinal direction of the timing belt 48 extends along the Y axial direction. A gripping member moving motor 45 transmits a drive force to the timing belt 48 through a drive portion 46. A support member position sensor 51 which is a sensor portion detects a position of the support member 35, and is used for controlling a position of the support member 35 in the Y axial direction which is moved by the gripping member moving motor 45.

As illustrated with broken lines and solid lines in FIGS. 3, 7A and 7B, the gripping member 11 can rotate and move in the sheet conveying direction with the above-described structure.

Figure 8A:
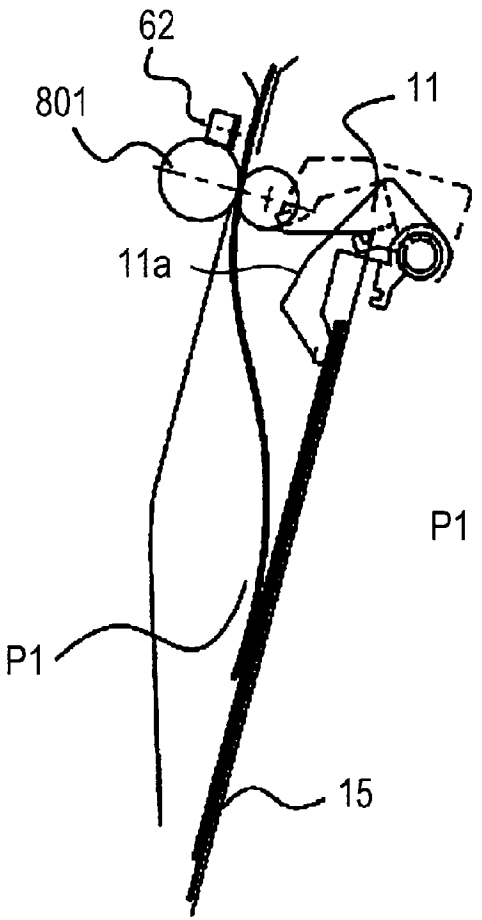
FIGS. 8A to 8C are enlarged views illustrating a structure of the gripping member and a positional relation between the gripping member and a sheet.
Figure 8B:
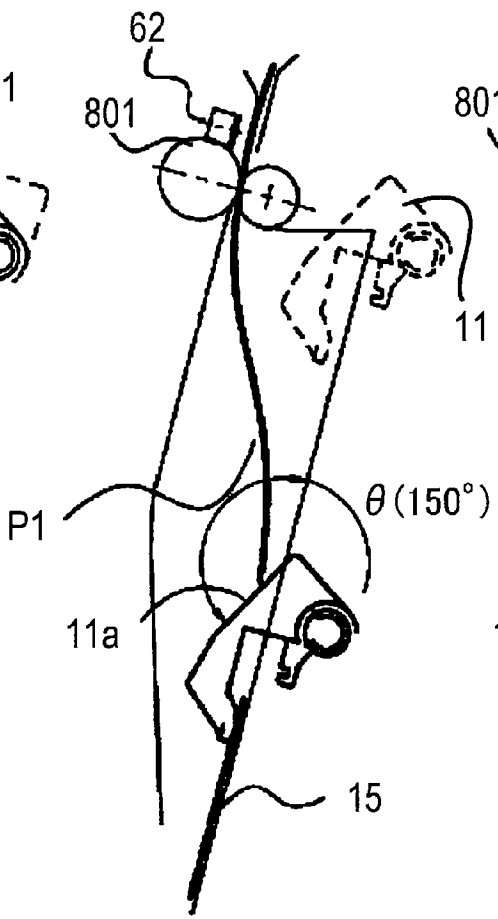
Figure 8C:
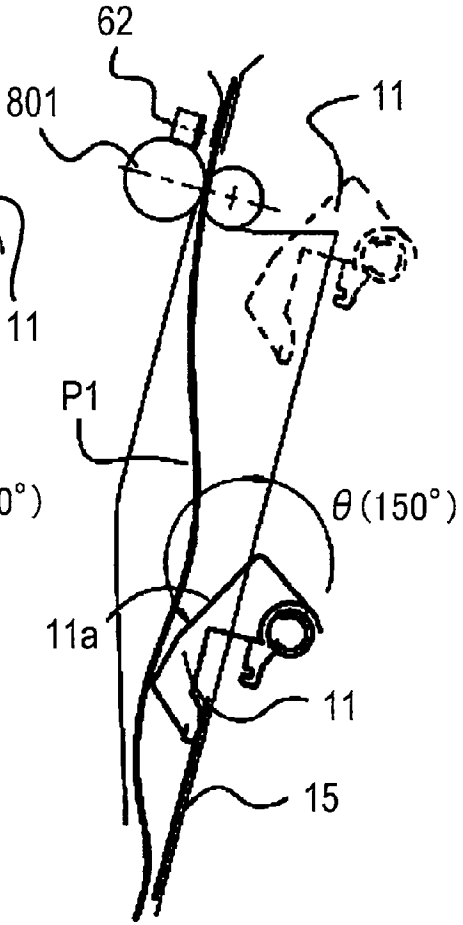

FIGS. 8A to 8C are enlarged views illustrating the structure of the gripping member 11 and a positional relation between the gripping member 11 and a sheet. As illustrated in FIGS. 8A to 8C, the gripping member 11 is formed with a paper-pass guide surface 11*a*. The angle of the paper-pass guide surface 11*a* with respect to the sheet stacking surface 15*a* of the stack tray 15 is set to an obtuse angle of θ°. In FIGS. 8A to 8C, the paper-pass guide surface 11*a* and the sheet stacking surface 15*a* of the stack tray 15 are set such that they intersect with each other at a predetermined obtuse angle of 150°.

Even when the front end of a sheet comes in contact with the stack tray 15 of the accommodating guide 803 (see FIG. 2) and then the sheet comes to the gripping member 11, the sheet P1 can be conveyed over the gripping member 11 without causing paper jam. With this structure, even when sheets of small size are stacked, the sheets are sorted by gripping the rear end portion (upper end portion of a stacked sheet bundle) such that the rear end portion (upper end portion) of the stacked sheet bundle and the front end portion (lower end portion) of a sheet P1 which is conveyed next do not collide against each other. For sorting sheets, it is also possible to employ such a structure that the relative positional relation of the pair of saddle entrance rollers 801 and the gripping member 11 is set to the positional relation as illustrated in FIG. 8A, and the pair of saddle entrance rollers 801 and the gripping member 11 are moved in the conveying direction according to the size of the sheet. However, if the angle of the paper-pass guide surface 11*a* is set to the above-described value, the apparatus can be compact in size since it is unnecessary to move the pair of saddle entrance rollers 801 in the conveying direction according to the size of the sheet.

The pair of first folding rollers 810*a* and 810*b* are provided downstream of the stapler 820 as illustrated in FIGS. 3 and 2. The thrusting member 830 is provided at a position opposed to the pair of first folding rollers 810*a* and 810*b*. The pair of first folding rollers 810*a* and 810*b* and the thrusting member 830 constitute a folding portion as a sheet processing portion. The pair of first folding rollers 810*a* and 810*b* and the thrusting member 830 as the sheet processing portion carries out folding processing on a sheet bundle at a folding position which is a processing position.

The thrusting member 830 projects toward the accommodated sheet bundle, and pushes the sheet bundle into the nip of the pair of first folding rollers 810*a* and 810*b*. Thereafter, the thrusting member 830 returns to a home position which is a position retracted from the accommodating guide 803. A force F11 which is sufficient for folding a sheet bundle is applied between the pair of folding rollers 810 by a spring (not illustrated).

A sheet bundle which is folded by the pair of folding rollers 810 is discharged to a folded bundle discharge tray 840 through a pair of first folded sheet conveying rollers 811*a* and 811*b* and a pair of second folded sheet conveying rollers 812*a* and 812*b*.

Forces F12 and F13 which are sufficient to convey and stop a folded sheet bundle are applied between the pair of first folded sheet conveying rollers 811*a* and 811*b* and between the pair of second folded sheet conveying rollers 812*a* and 812*b*.

A conveying guide 813 guides a sheet bundle between the pair of folding rollers 810 and the pair of first folded sheet conveying rollers 811. A conveying guide 814 guides a sheet bundle between the pair of first folded sheet conveying rollers 811 and the pair of second folded sheet conveying rollers 812. The pair of folding rollers 810, the pair of first folded sheet conveying rollers 811 and the pair of second folded sheet conveying rollers 812 nip a folded sheet bundle from both surfaces and rotate the same at a constant speed by the same motor M4 (see FIG. 2).

The folding processing of a sheet bundle which is bound by the stapler 820 is carried out after a sheet receiving member 805 lowers the sheet bundle by a predetermined distance from a position where the staple processing was carried out, and the staple position of the sheet bundle matches with a nip position of the pair of folding rollers 810. As a result, the sheet bundle is folded with the portion which is stapled (bound) positioned in the center.

An aligning plate 815 width-aligns sheets accommodated in the accommodating guide 803, by moving sheets in a nipping direction by a motor M5 (see FIG. 2) and positioning (aligning) the sheets in the widthwise direction.

A crease press unit 860 as a fold processing unit is provided downstream of the pair of second folded sheet conveying rollers 812. The crease press unit 860 includes a press holder 862 which supports the pair of press rollers 861, and in a state where the pair of press rollers 861 nip the crease, the press holder 862 is moved in the crease direction, thereby enhancing the crease. A first conveyer belt 849 is disposed directly below the crease press unit 860. A sheet bundle is conveyed from the first conveyer belt 849 to a second conveyer belt 842, and stacked on a discharge tray 843 from the second conveyer belt 842.

Next, the inserter 900 provided on an upper portion of the finisher 500 will be described based on FIG. 2. As illustrated in FIG. 2, the inserter 900 is an apparatus which inserts a sheet (insert sheet) which is different from a normal sheet as a top page, last page or intermediate page of sheets (recording paper sheets) on which images are formed by the printer portion 300. The insert sheet of the top page or last page is a cover sheet.

The inserter 900 feeds a sheet set in insert trays 901 and 902 by a user to any of the sample tray 701, the stack tray 700 and a folded bundle tray 890 without passing through the printer portion 300. The inserter 900 separates the sheet bundle stacked on the insert trays 901 and 902 one sheet by one sheet, and sends the sheet to the conveying path 520 of the finisher 500 at a desired timing.

Figure 9:
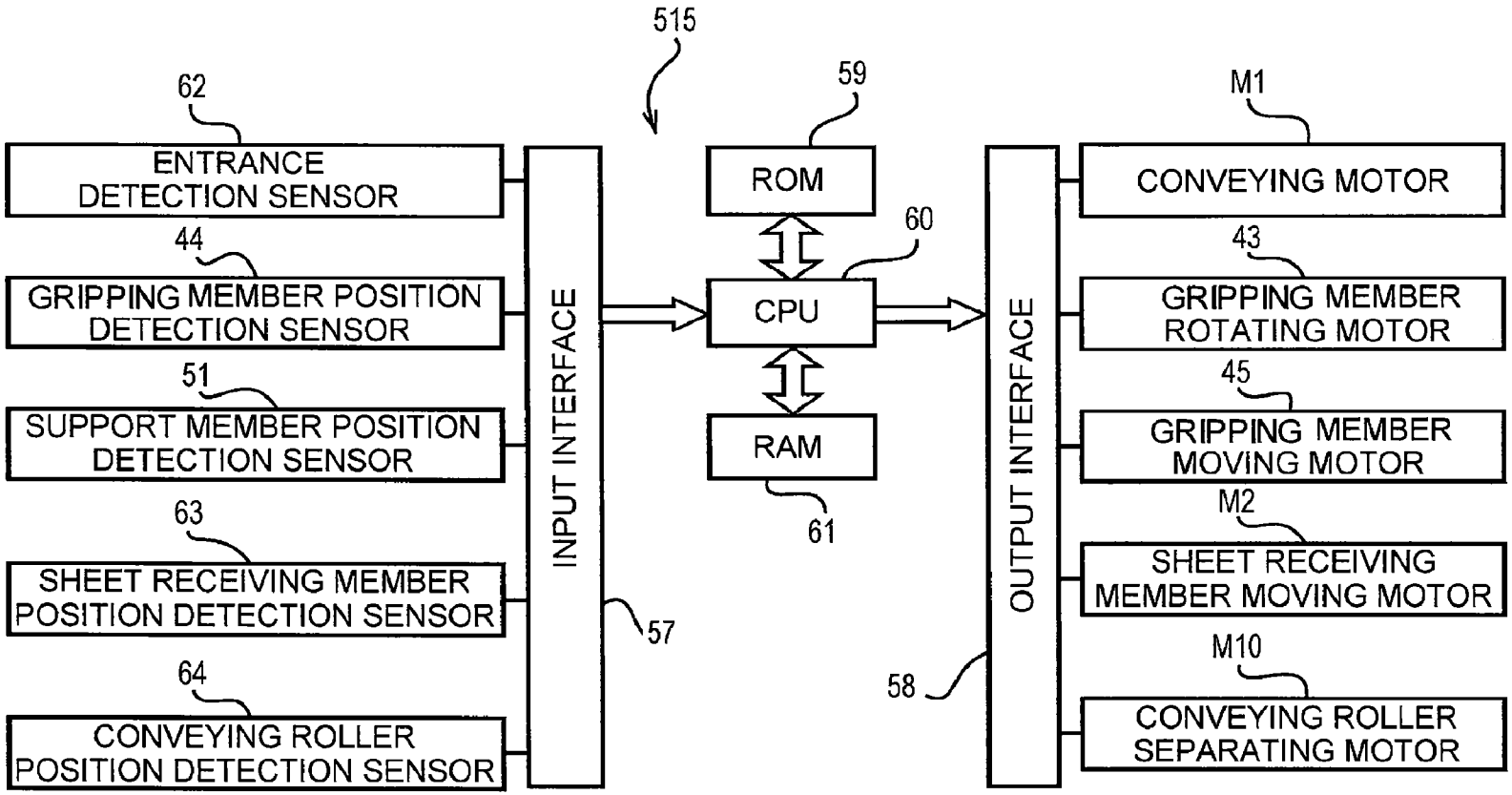
FIG. 9 is a function block diagram illustrating a structure of a finisher controlling portion of the finisher.

Next, a structure of a controlling portion of the finisher 500 which is the sheet processing apparatus will be described using FIG. 9. FIG. 9 is a function block diagram illustrating a structure of the finisher controlling portion 515 of the finisher 500 which is a sheet post-processing apparatus. As illustrated in FIG. 9, the finisher controlling portion 515 comprises a microcomputer system, and includes a CPU 60 as a controlling portion, a ROM 59 and a RAM 61. A puncher processing program and a stapling processing program are previously stored in the ROM 59. The CPU 60 executes the programs, swaps data with the RAM 61 and executes input data processing, thereby generating a predetermined control signal.

Detection signals from an entrance detection sensor 62, the gripping member position detection sensor 44, the support member position sensor 51, a sheet receiving member position detection sensor 63 and a conveying roller position detection sensor 64 are input to the CPU 60 as input data through an input interface circuit 57. Various control signals are output from the CPU 60 through an output interface circuit 58. The output signals are sent to a control device such as a motor driver to control the control device and operate the conveying motor M1, the gripping member rotating motor 43, the gripping member moving motor 45, the sheet receiving member moving motor M2 and a conveying roller separating motor M10. Data is sent and received between the CPU 60 and a later-described copying machine body side CPU circuit portion 150 provided on a body of the copying machine 1000. The embodiment described above concern the configuration in which the operation is controlled by the finisher control portion 515 included in the finisher 500. Alternatively, the CPU 60 may be integrated into the control circuit portion 150 of a body of the copying machine 1000 so that the operation is directly controlled from the copying machine 1000. The CPU 60 controls the movement of the gripping member 11 and the gripper 71 so as to adjust a position of the sheet gripped by the gripping member 11 and the gripper 71 corresponding to the sheet processing portion in the direction along the inclination of the sheet stacking surface 15*a*.

Figure 10:
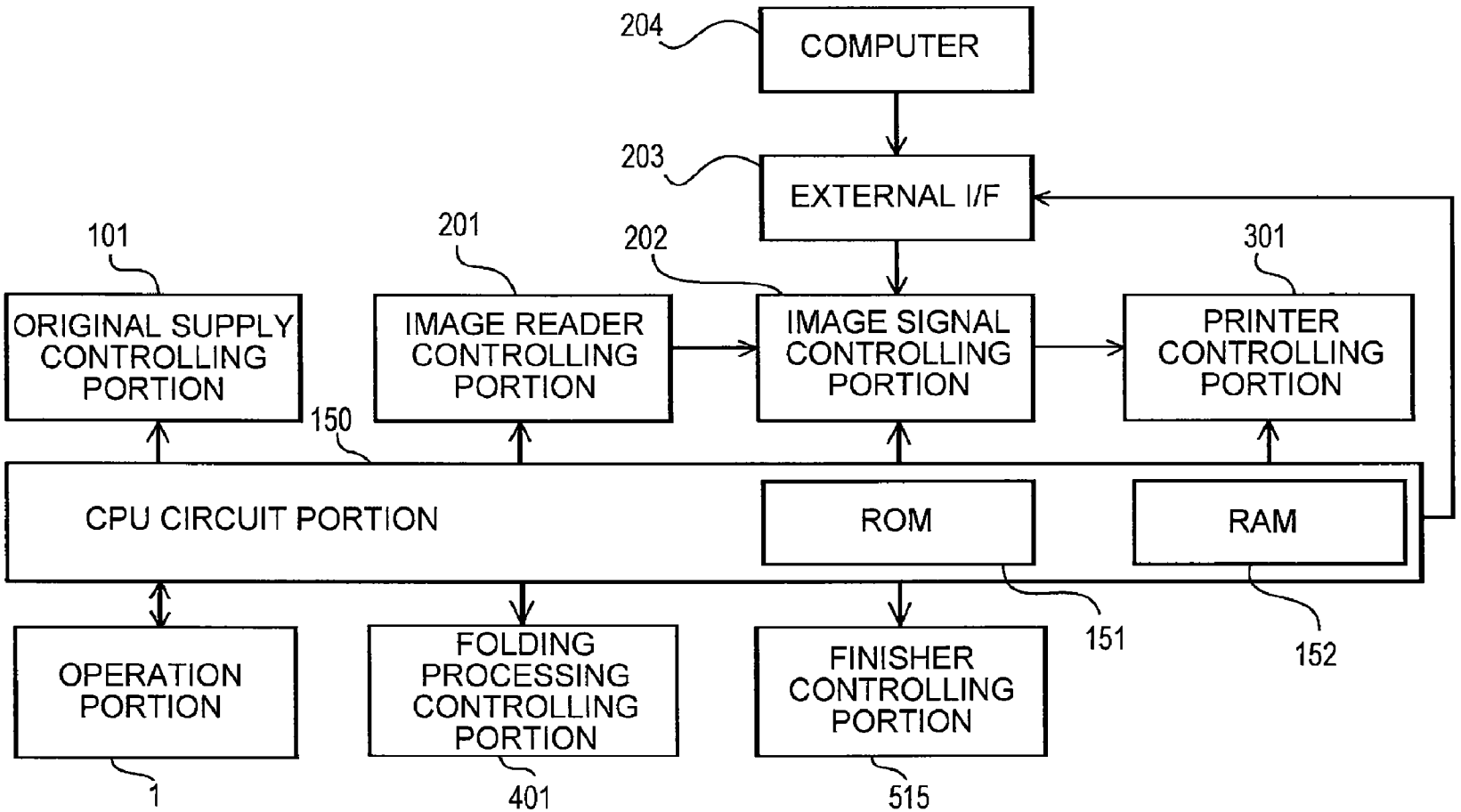
FIG. 10 is a control block diagram of the controlling portion of the copying machine.

Next, a structure of a controlling portion of the copying machine 1000 which is the image forming apparatus will be described using FIG. 10. FIG. 10 is a control block diagram of the copying machine 1000. The CPU circuit portion 150 includes a CPU (not illustrated). The CPU circuit portion 150 controls an original supply controlling portion 101, an image reader controlling portion 201, an image signal controlling portion 202 and a printer controlling portion 301 based on control programs stored in an ROM 151 and settings by the operation portion 1. The CPU circuit portion 150 also controls a folding processing controlling portion 401, the finisher controlling portion 515 and an external I/F 203 based on control programs stored in the ROM 151 and settings by the operation portion 1.

The original supply controlling portion 101 controls the original supply portion 100, the image reader controlling portion 201 controls the image reader portion 200, the printer controlling portion 301 controls the printer portion 300, and the folding processing controlling portion 401 controls the folding processing portion 400. The finisher controlling portion 515 controls the finisher 500, the saddle stitch binding portion 800 and the inserter 900.

The operation portion 1 includes a plurality of keys for setting various functions concerning the image formation, and displays for displaying a setting state. The operation portion 1 outputs, to the CPU circuit portion 150, key signals corresponding to operations of the keys by a user, and displays, on the displays, corresponding information based on the signals from the CPU circuit portion 150.

The RAM 152 is used as a region where control data is temporarily held and as a working area of computation required with control. The external I/F 203 is an interface between the copying machine 1000 and the external computer 204, develops print data from the computer 204 into bit-mapped image, and outputs the image to the image signal controlling portion 202 as image data. An image of an original D which was read by the image sensor (not illustrated) is output from the image reader controlling portion 201 to the image signal controlling portion 202. The printer controlling portion 301 outputs image data from the image signal controlling portion 202 to an exposure controlling portion (not illustrated).

Sheet information and conditions concerning the kinds of sheet (plain paper, coated paper, special paper) and sheet size are input from an operation panel of the image forming apparatus body by the operation of a user, and the CPU circuit portion 150 can obtain and recognize these sheet conditions. The sheet conditions include stiffness, thickness, grammage, surface resistance, physical properties (surface properties) such as smoothness, and sheet kinds such as punch paper and tab paper, in addition to the sheet size.

Figure 11A:
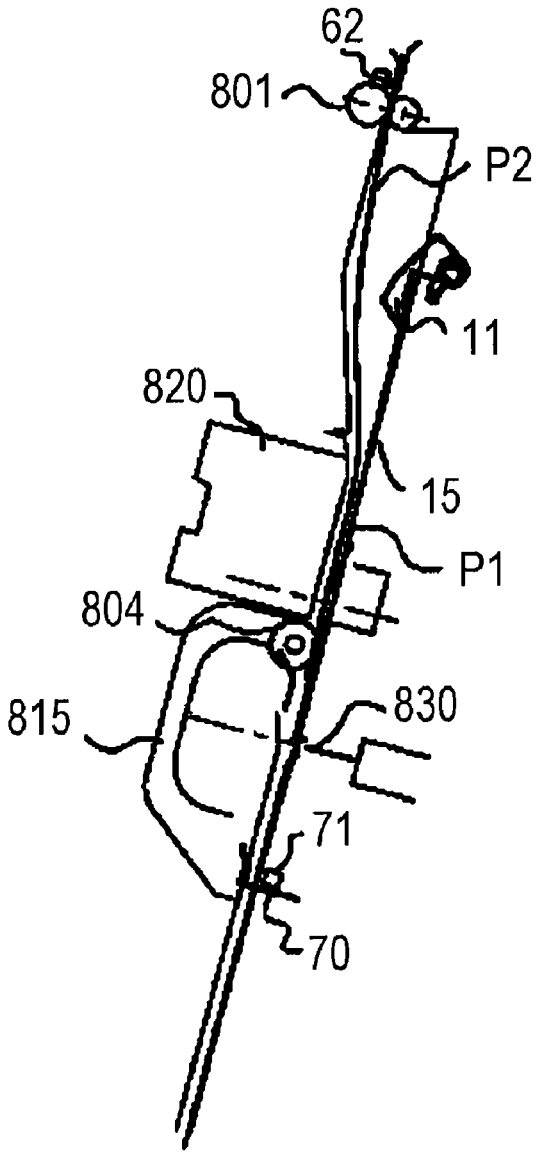
FIGS. 11A and 11B are diagrams of procedures illustrating a driving operation of the gripping member and a sheet conveying operation.
Figure 11B:
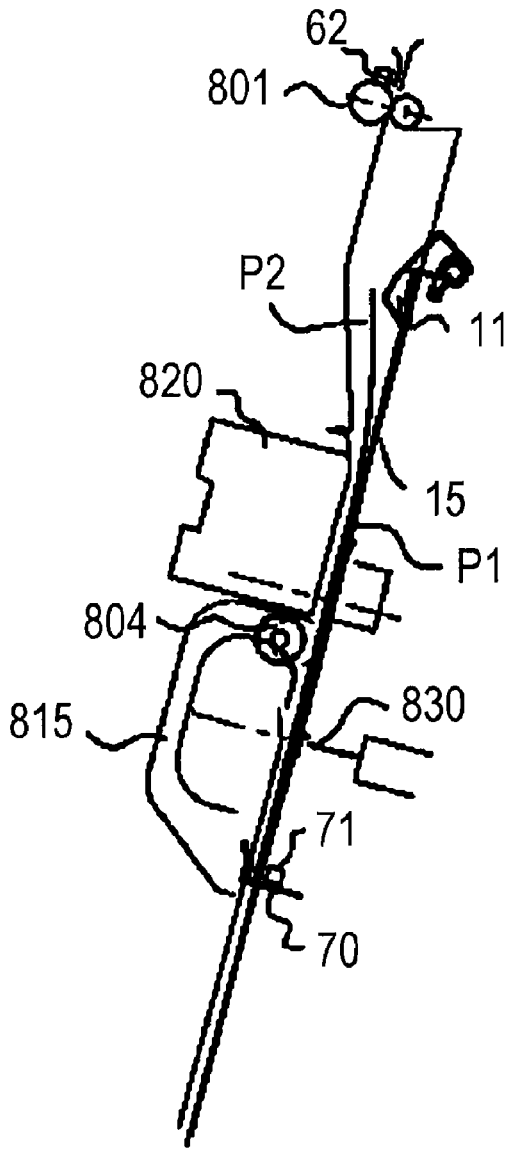

Next, a driving operation of the gripping member 11 and a sheet conveying operation will be described using FIGS. 11A, 11B, 12A and 12B. FIGS. 11A, 11B, 12A and 12B are diagrams of procedures illustrating a driving operation of the gripping member and a sheet conveying operation. As illustrated in FIG. 11A, when the gripping member 11 grips the rear end portion (upper end portion) of a sheet P1 on the stack tray 15, a next sheet P2 is delivered to the conveying roller 804 from the pair of saddle entrance rollers 801. At this time, the gripper 71 is retracted to a position which does not project from the stack tray 15. Next, as illustrated in FIG. 11B, if the sheet P2 is conveyed to the conveying roller 804, the conveying roller 804 is separated from the sheet P2 after the front end (lower end) of the sheet P2 in the conveying direction is conveyed to a position near the sheet receiving member 70.

Figure 12A:
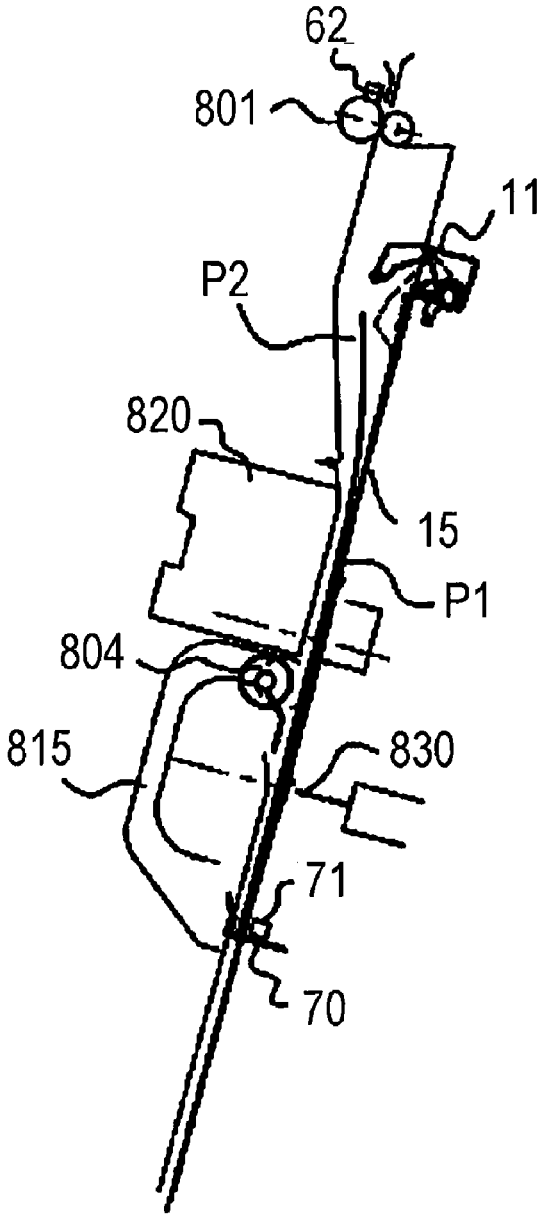
FIGS. 12A and 12B are diagrams of procedures illustrating a driving operation of the gripping member and a sheet conveying operation.
Figure 12B:
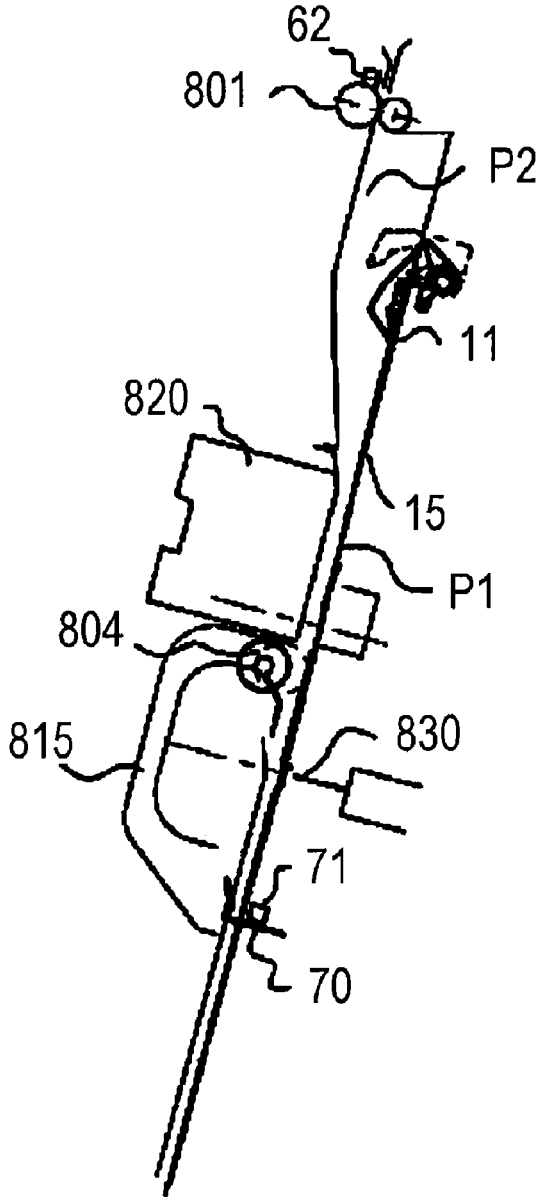

Next, as illustrated in FIG. 12A, when the gripping member 11 rotates to the retracted position, the aligning plate 815 aligns the sheet P1 and the sheet P2 in a direction orthogonal to the conveying direction. Next, as illustrated in FIG. 12B, when the gripping member 11 rotates to the pressing position, the gripping member 11 grips the rear end portion (upper end portion) of the sheet P2. With the above operation illustrated in FIGS. 11A, 11B, 12A and 12B, a predetermined number of sheets are stacked from the first sheet in order.

With this operation, when the sheet P2 is conveyed by the conveying roller 804, since the gripping member 11 grips the sheet P1 as illustrated in FIGS. 11A, B, 12A and 12B, the sheet P1 is not conveyed together with the sheet P2 and thus is not buckled.

FIGS. 13A and 13B are explanatory diagrams illustrating a relation of the gripping force F1 of the gripping member 11 and a friction coefficient. A relation between a gripping force F1 of the gripping member 11, a conveying force Fr of the conveying roller 804 and a friction coefficient with respect to a conveyed sheet can be set to satisfy the following expressions (1) and (2).

When the number of currently stacked sheets is one, the following expression (1) is established.

$$F1>\mu ssFr/(\mu so+\mu st) \quad (1)$$

When the number of currently stacked sheets is two or more, the following expression (2) is established.

$$F1>ssFr/(\mu so+\mu ss) \quad (2)$$

where F1 is a gripping force of the gripping member 11, Fr is a gripping force of the conveying roller 804, μso is a friction coefficient between the gripping member 11 and a sheet, μst is a friction coefficient between the sheet stacking surface 15*a* of the stack tray 15 and a sheet, μrs is a friction coefficient between the conveying roller 804-1 and a sheet, μrls is a friction coefficient between a following roller (counter roller 804-2 of the conveying roller 804-1) and a sheet, and μss is a friction coefficient between sheets. The counter roller 804-2 is a member which is supplementarily used for describing a relation between the gripping force F1 of the gripping member 11 and the friction coefficient in FIG. 13B, and the counter roller 804-2 is not essentially required in the present invention.

That is, it is preferable that a gripping force (resistance) of the gripping member 11 is set greater than a conveying force of the conveying roller 804. For example, a gripping surface of the gripping member 11 may be provided with a high friction member such as rubber.

FIGS. 14A to 14D are diagrams of procedures illustrating the driving operation of the gripping member 11 and the sheet receiving member 70 having the gripper 71, and the sheet conveying operation. FIGS. 14A to 14D illustrate operation after the stacking operation of sheets is completed and before the stapling processing is carried out by the stapler 820.

To form one sheet bundle which is a resultant as illustrated in FIG. 14A, the gripper 71 and the gripping member 11 grip the front end portion (lower end portion) and rear end portion (upper end portion) of the sheet bundle Pn in the direction along the inclination of the sheet stacking surface 15*a* in a state where the stacking operation and the aligning operation of all of the sheets are completed. In the embodiment described above, sheet gripping positions gripped by the gripper 71 and the gripping member 11 on the sheet bundle Pn are not limited to the front end portion (lower end portion) and rear end portion (upper end portion) of the sheet bundle Pn in the direction along the inclination of the sheet stacking surface 15*a*, the gripping positions may be a predetermined position (first position) on the sheet bundle Pn and a second position where is away form the first position in the direction along the inclination of the sheet stacking surface 15*a*. When the amount of rotation of the gripping member rotating motor 43 is controlled at this time, the gripping force F1 of the gripping member 11 is changed. With this, the gripping force F1 of the gripping member 11 is set smaller than a gripping force F2 of the gripper 71. That is, these forces are set to be F1<F2. At this time, each sheet is buckled due to its own weight.

The gripping member 11 and the sheet receiving member 70 having the gripper 71 move the sheet bundle Pn upward (toward the rear end side of the sheet in the direction along the inclination of the sheet stacking surface 15*a*) in cooperation with each other. The actuation timing when the sheet bundle is moved is as follows. When the sheet bundle Pn is moved toward the rear end in the direction along the inclination of the sheet stacking surface 15*a* (a direction from the gripper 71 to the gripping member 11), the actuating timing of the gripping member 11 is relatively earlier than the actuating timing of the gripper 71. With this, even if a weak sheet is prone to be buckled due to its own weight, the sheet bundle erects, and thus the buckle of the sheet bundle is overcome.

FIG. 14B illustrates a state where the gripping member 11 moves upward by a predetermined amount (L1). As can be seen by comparing with FIG. 14A, the buckled sheet erects. Since the gripping force F1 of the gripping member 11 is set smaller than the gripping force F2 of the gripper 71 as described above, after the sheet erects, the gripping member 11 and the sheet slip by a predetermined amount. FIG. 14D is a detailed view of FIG. 14B. Such a difference between the gripping force F1 of the gripping member 11 and the gripping force F2 of the gripper 71 prevent the sheet from breaking. In the embodiment described above, the gripping force F1 of the gripping member 11 is set smaller than the gripping force F2 of the gripper 71, but the gripping force F2 of the gripper 71 may be set smaller than the gripping force F1 of the gripping member 11, if there is a difference between the gripping force F1 of the gripping member 11 and the gripping force F2 of the gripper 71.

FIG. 14C illustrates a state where the sheet receiving member 70 and the gripping member 11 are moved in a direction illustrated with the arrow such that the central portion of the sheet bundle Pn in the conveying direction is adjusted to the staple position (processing position) of the stapler 820. The sheet bundle Pn is gripped by the gripper 71 and the gripping member 11 at the position corresponding the stapler 820, and the sheet bundle Pn is stapled in this state.

By the above-described operation of the gripping member 11, a sheet or a sheet bundle processed on the substantially vertical stack tray 15 (accommodating guide 803) can be subjected to the stapling processing in a state where the sheet or the sheet bundle which was buckled due to its own weight erects.

In the above description, the accommodating (aligning) position of a sheet is located below the stapling position of a sheet bundle, but the present invention is not limited to this. When the accommodating (aligning) position of a sheet is the same as the stapling position of a sheet bundle, the operation illustrated in FIG. 14C is not carried out, and the operation up to the state where the gripping member 11 is moved upward by the predetermined amount (L1) illustrated in FIGS. 14B and 14D is carried out. With this, the sheet bundle can be subjected to the stapling processing in a state where the sheet bundle which was buckled due to its own weight erects.

The stopping timing of the gripping member 11 may be delayed by a predetermined time from the stopping timing of the gripper 71 after a sheet bundle is moved to the stapling position in a direction from the gripper 71 to the gripping member 11, illustrated in FIG. 14C. With this, in a state where the front end portion (lower end portion) of a sheet is fixed by the gripper 71, the gripping member 11 is moved upward for a predetermined time. Therefore, the buckling of a sheet bundle is overcome.

Figure 17:
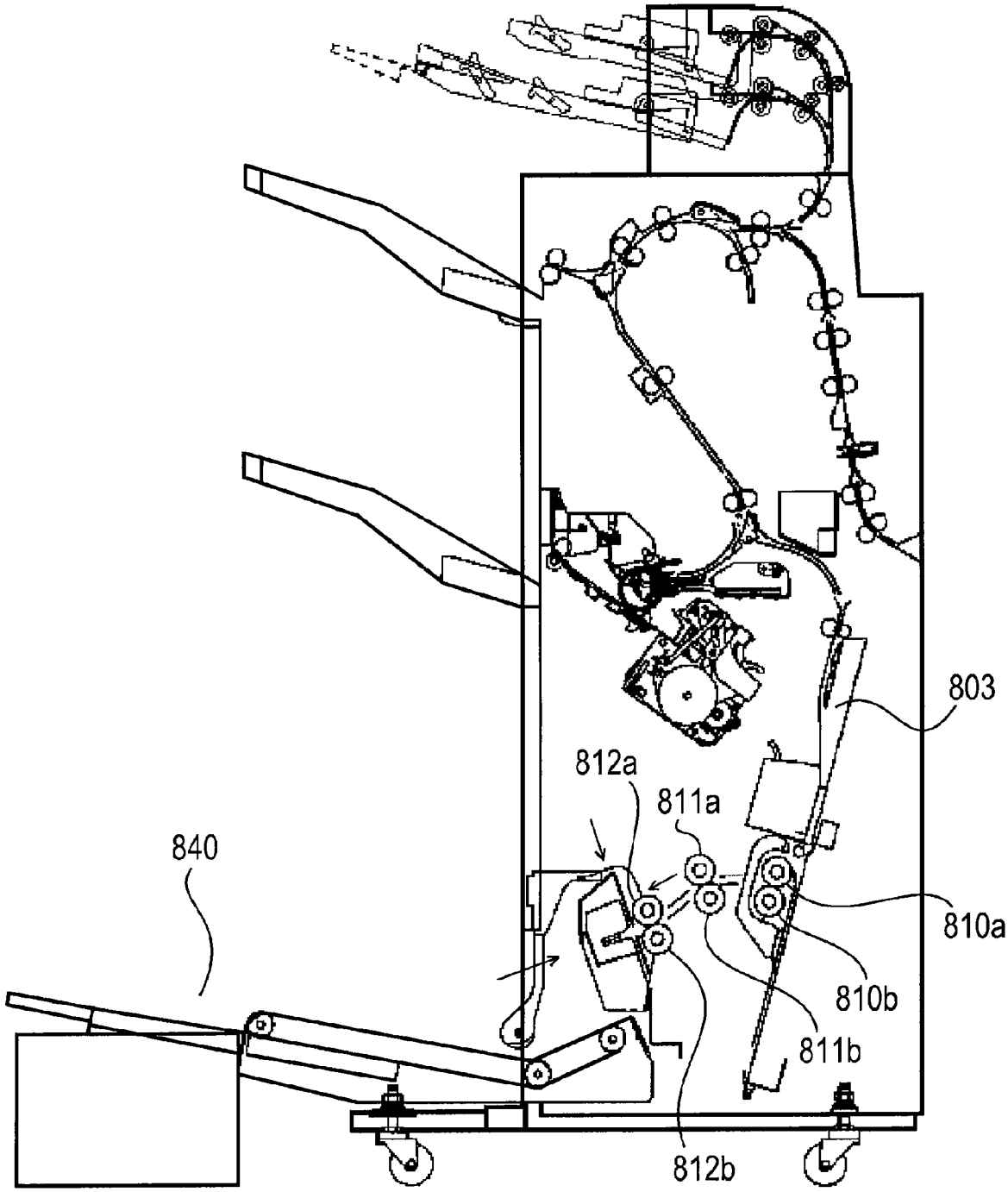
FIG. 17 PRIOR ART
FIG. 17 is a sectional view illustrating a structure of a conventional sheet processing apparatus.
Figure 18A:
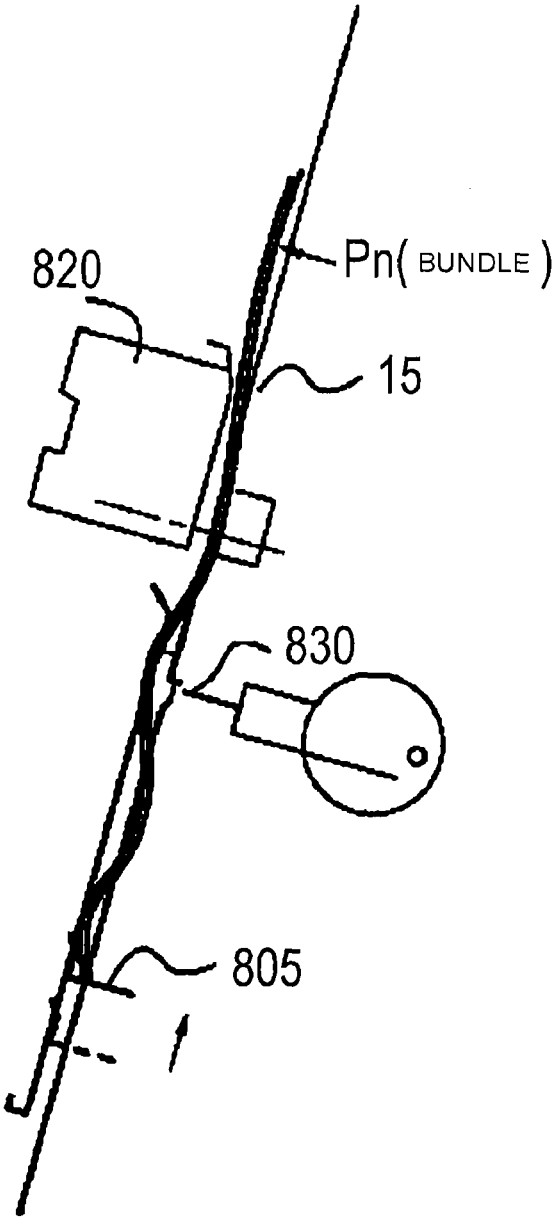
FIG. 18A PRIOR ART
FIGS. 18A and 18B are diagrams of procedures illustrating operation of the conventional sheet processing apparatus.
Figure 18B:
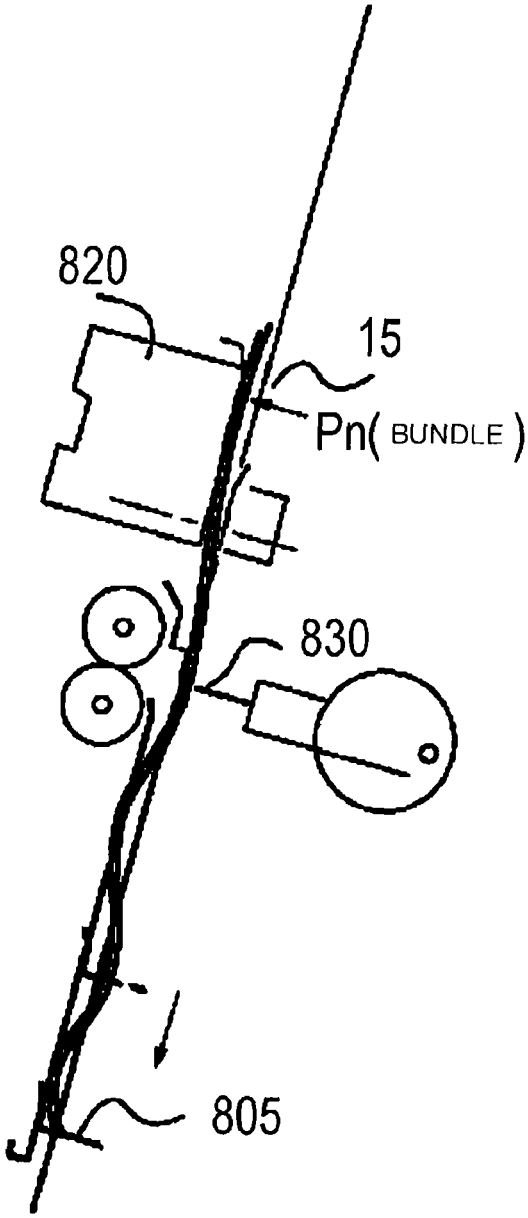
FIG. 18B PRIOR ART
Figure 19:
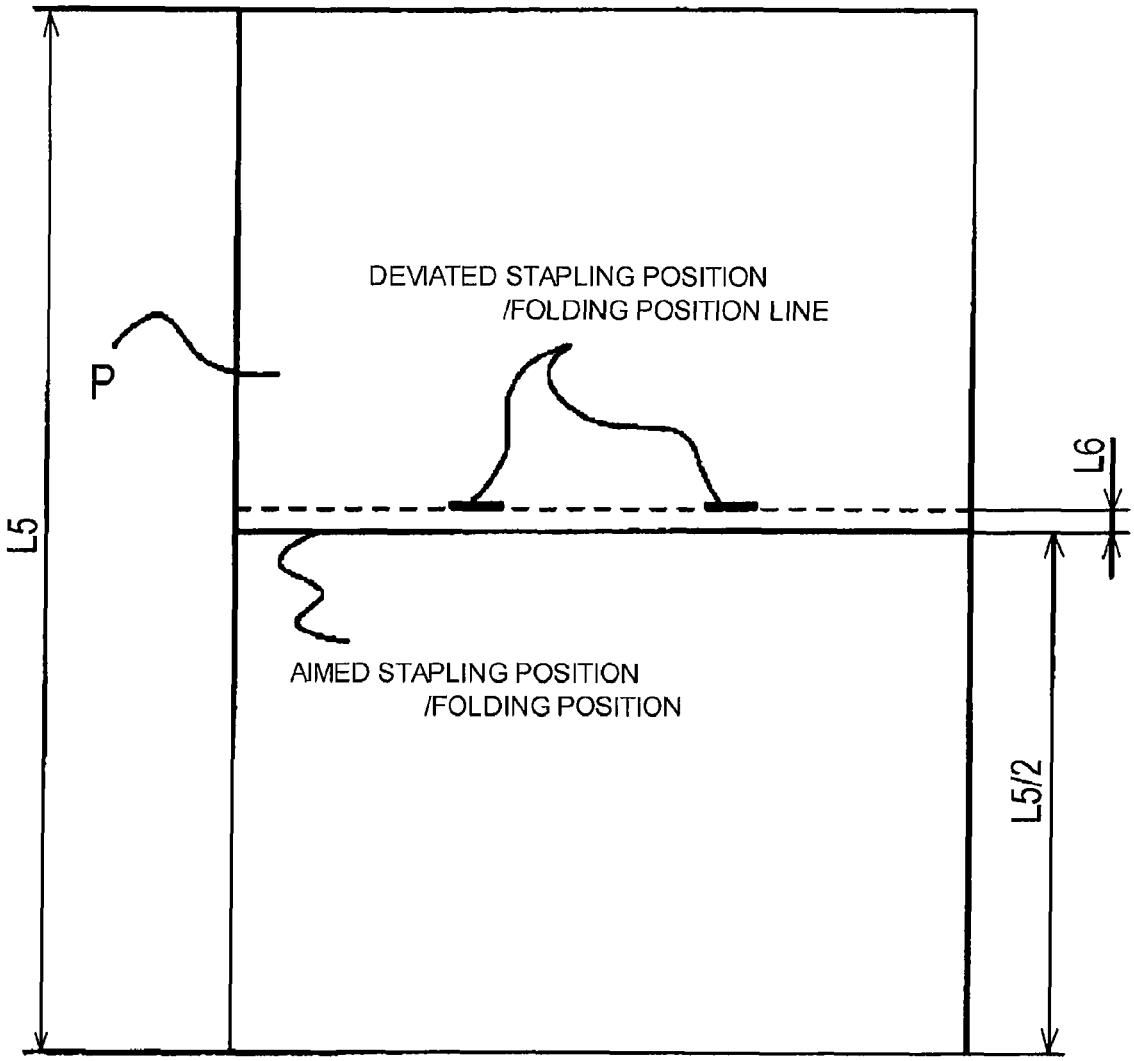
FIG. 19 PRIOR ART
FIG. 19 is a plan view of a sheet for describing a problem of the conventional sheet processing apparatus.

As illustrated in FIG. 17 as a background technique, when a sheet bundle is moved upward only by the sheet receiving member 70 located below the sheet bundle, rigidity of sheets may be weaker than the acceleration force in starting the movement. However, if the sheet receiving member 70 moves the sheet bundle in cooperation with the gripping member 11 to the processing position of the stapler 820 and the thrusting member 830 as described above, the buckling is overcome.

By changing the actuation timing and the stopping timing of the gripping member 11 and the sheet receiving member 70 having the gripper 71, the erecting state of the sheet bundle is further secured, and undesired stapling position and undesired folding position caused by buckling of sheets are further overcome.

Figure 15:
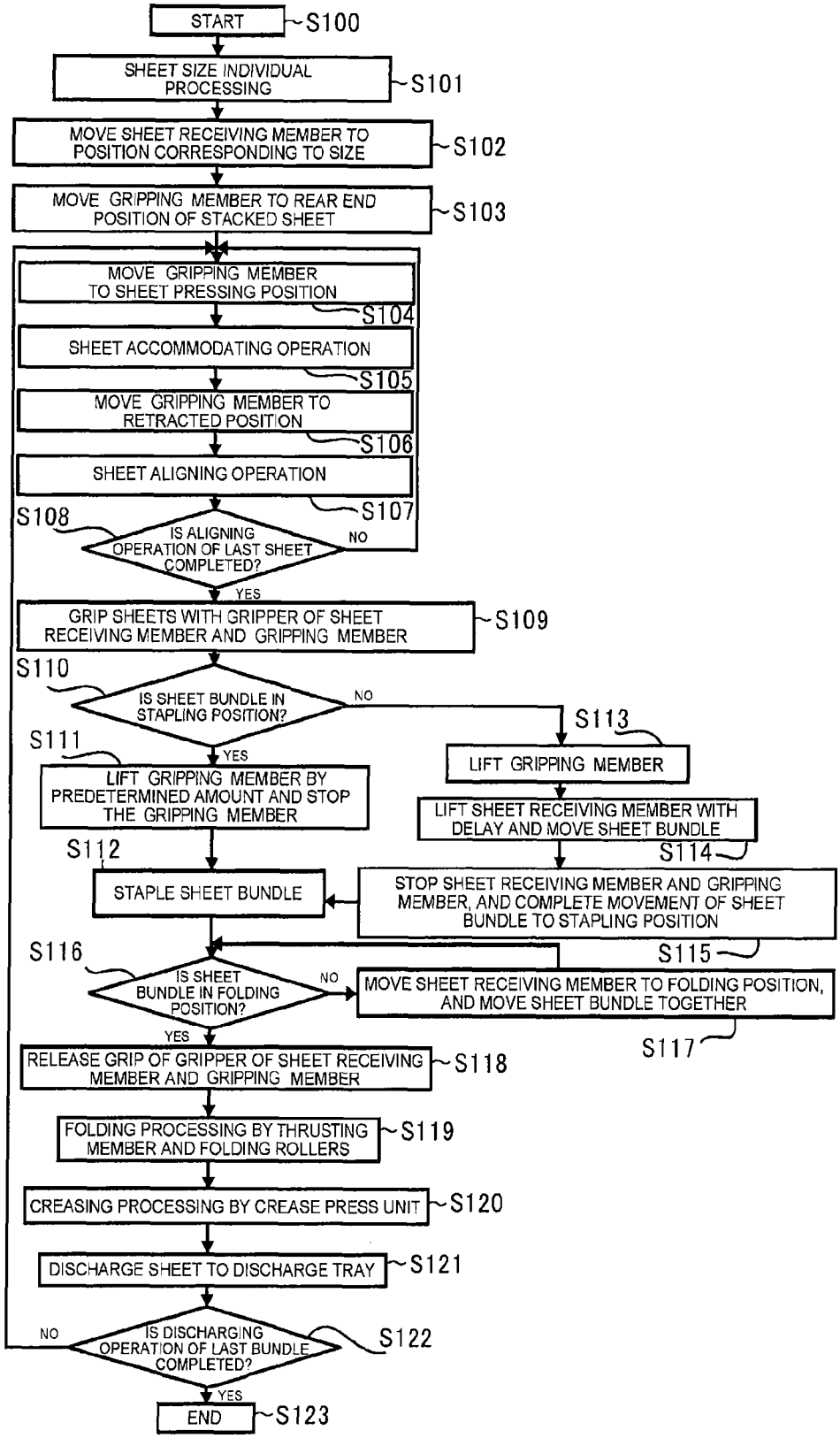
FIG. 15 is a flowchart illustrating control procedure of the sheet processing apparatus.

Next, the operation flow of the sheet processing apparatus will be described using FIG. 15. FIG. 15 is a flowchart illustrating control steps of the sheet processing apparatus. As illustrated in FIG. 15, when the sheet processing apparatus starts operation (step 100; step is referred to as "S", hereinafter), sheet size individual processing is carried out (S101). The sheet size individual processing refers to processing in which sheet size information which is input from the operation portion 1 or the computer 204 and recognized by the CPU circuit portion 150 of the copying machine body is transmitted to the finisher controlling portion 515.

The sheet receiving member moves to a position corresponding to that size of the sheet (S102). The gripping member 11 then moves to a rear end position (rear end in the direction along the inclination of the sheet stacking surface 15*a*) of the sheet stacked on the stack tray 15 (S103). When the sheet is discharged to the stack tray 15, the gripping member 11 moves to a pressing position where the gripping member 11 grips the rear end portion of the sheet in the direction along the inclination of the sheet stacking surface 15*a* (S104). When a next sheet is discharged (S105), the gripping member 11 moves to the retracted position (S106), and the sheets or the sheet bundle stacked on the stack tray 15 are aligned (S107).

Thereafter, it is determined whether the aligning operation of the last sheet is completed (S108). If the aligning operation of the last sheet is completed, the gripper 71 of the sheet receiving member 70 and the gripping member 11 grip the front end portion and the rear end portion of the aligned sheet bundle in the direction along the inclination of the sheet stacking surface 15*a* in cooperation with each other (S109). If the aligning operation of the last sheet is not completed, the gripping member 11 again moves to the sheet pressing position (S104), and the operation is repeated until the aligning operation of the last sheet is completed.

After the gripper 71 and the gripping member 11 grip the sheet bundle (S109), it is determined whether the sheet bundle is in the stapling position (S110). If the sheet bundle is in the stapling position, the gripping member 11 is moved upward by a predetermined amount and stopped (S111). With this, if the sheet bundle is buckled, the buckling is overcome. If the sheet bundle is not in the stapling position, the gripping member 11 is first moved upward (S113) and then, the sheet receiving member 70 is moved upward to move the sheet bundle to the stapling position (S114). The sheet receiving member 70 and the gripping member 11 stop, and the movement of the sheet bundle to the stapling position is completed (S115). Even if the sheet bundle is still buckled, the buckled can also be overcome by this operation. The sheet bundle whose buckling is overcome is subjected to the stapling processing by the stapler 820 at the stapling position (S112).

When the sheet bundle is stapled, it is determined whether the sheet bundle is disposed in the folding position (S116). If the sheet bundle is not in the folding position, the sheet receiving member 70 and the gripping member 11 are moved (S117), to move the sheet bundle to the folding position. If the sheet bundle is in the folding position, the gripping state of the gripping member 11 and the gripper 71 of the sheet receiving member 70 is released (S118).

When the gripping state by the gripper 71 and the gripping member 11 is released (S118), the sheet bundle is subjected to the folding processing by the thrusting member 830 and the pair of folding rollers 810 (S119). Further, the folded sheet bundle is subjected to the creasing processing by the crease press unit 860 (S120). The processed sheet bundle is discharged to the discharge tray 843 (S121). Then, it is determined whether the discharging operation of the last sheet bundle is completed (S122). If the discharging operation of the last sheet bundle is completed, the operation of the sheet processing apparatus 10 is completed (S123). If the discharging operation of the last sheet bundle is not completed, the gripping member 11 is again moved to the sheet pressing position (S104), and the operation is repeated until the last sheet bundle is discharged.

The front end portion of a sheet discharged to the stack tray 15 in the direction along the inclination of the sheet stacking surface 15*a* is gripped by the gripper 71, and the rear end portion of the sheet in the direction along the inclination of the sheet stacking surface 15*a* is gripped by the gripping member 11 as described above. The gripped sheet bundle is moved by the gripper 71 and the gripping member 11 in cooperation with each other. With this, it is possible to prevent a processing position from being deviated due to buckling of the sheet bundle without increasing the size of the apparatus, and many kinds of diversified sheets can be handled.

Second Embodiment

In the embodiment described above, the accommodating (aligning) position of sheets is lower than (or the same position as) the stapling position (or folding position) of a sheet bundle. In the second embodiment, the accommodating (aligning) position of sheets is higher than the stapling position (or folding position) of a sheet bundle.

FIGS. 16A to 16D illustrate a saddle stitch binding portion 800 of a sheet processing apparatus according to the second embodiment, and are procedure diagrams illustrating a driving operation of a gripping member 11 and a sheet receiving member 70 having a gripper 71, and a sheet conveying operation. FIG. 16 illustrates operation after the stacking operation of sheets is completed and before the stapling processing is carried out by a stapler 820.

In the following description, the outline structure of the entire image forming apparatus is substantially the same as that of the previous embodiment except the above-described operation, and thus members having equal functions are designated with the same reference symbols, and detailed description thereof will not be repeated.

As illustrated in FIGS. 16A, 16B and 16C, the sheet receiving member 70 and the gripping member 11 are moved downward (direction illustrated with the arrows) such that the central portion of a sheet bundle Pn in the discharging direction comes to a processing position (stapling position or folding position). The operation in FIGS. 16A to 16D is different from that illustrated in FIGS. 14A to 14D in this respect. The stapling position corresponds to the position of the stapler 820, and the folding position corresponds to a position of the thrusting member 830. A case where a sheet bundle is moved from the accommodating position of the sheet bundle to the lower folding position will be described.

As illustrated in FIG. 16A, to form one sheet bundle which is a resultant, the gripper 71 and the gripping member 11 grip the front end portion (lower end portion) and the rear end portion (upper end portion) of the sheet bundle Pn in the direction along the inclination of the sheet stacking surface 15*a* in a state where the stacking operation and the aligning operation of all of the sheets are completed. At this time, when the rotation amount of the gripping member rotating motor 43 is controlled, the gripping force F1 of the gripping member 11 is changed. Specifically, the gripping force F1 of the gripping member 11 is set smaller than the gripping force F2 of the gripper 71. That is, these forces are set to be F1<F2. At this time, each sheet is buckled due to its own weight. The sheet bundle Pn may be or may not be stapled.

The gripping member 11 and the sheet receiving member 70 having the gripper 71 move the sheet bundle Pn downward (toward the front end of the sheets in the direction along the inclination of the sheet stacking surface 15*a*) in cooperation with each other. The actuating timing when the sheet bundle is moved is set such that the actuating timing of the gripping member 11 is delayed relative to the actuating timing of the gripper 71 when the sheet bundle Pn is moved toward the front end thereof in the direction along the inclination of the sheet stacking surface 15*a* (a direction from the gripping member 11 to the gripper 71). With this, even if a weak sheet is prone to be buckled due to its own weight, the sheet bundle erects and the buckling of the sheet bundle is overcome.

FIG. 16B illustrated a state where the sheet receiving member 70 is moved downward by a predetermined amount (distance L2) in a state where the gripper 71 grips a sheet or a sheet bundle. As can be seen by comparing with FIG. 16A, the buckled sheet erects. Since the gripping force F1 of the gripping member 11 is set smaller than the gripping force F2 of the gripper 71 as described above, after the sheet erects, the gripping member 11 and the sheet slip by a predetermined amount. FIG. 16D is a detailed view of FIG. 16B.

FIG. 16C illustrates a state where the sheet receiving member 70 and the gripping member 11 are moved in a direction illustrated with the arrow such that the central portion of the sheet bundle Pn in the conveying direction comes to the folding position (processing position) where the thrusting member 830 is located. The state where the sheet bundle Pn is gripped by the gripper 71 and the gripping member 11 is released when or immediately before the operation of the thrusting member 830 is started, and the folding operation of the sheet bundle Pn is started.

By the above-described operation of the gripping member 11, a sheet or a sheet bundle processed on the substantially vertical stack tray 15 (accommodating guide 803) can be subjected to the folding processing in a state where the sheet or the sheet bundle which was buckled due to its own weight erects.

In the above description, the accommodating (aligning) position of a sheet is located above the folding position of a sheet bundle, but the present invention is not limited to this. When the accommodating (aligning) position of a sheet is the same as the folding position of a sheet bundle, the operation up to the state where the gripping member 11 is moved upward by the predetermined amount (L1) illustrated in FIGS. 14B and 14D is carried out. With this, the sheet bundle can be subjected to the folding processing in a state where the sheet bundle which was buckled due to its own weight erects.

After a sheet bundle is moved to the folding position in a direction from the gripping member 11 to the gripper 71, illustrated in FIG. 16C, the stopping timing of the gripping member 11 may be set earlier than the stopping timing of the sheet receiving member 70 by a predetermined time (corresponding to a distance L2). With this, the gripper 71 is moved downward for the predetermined time in a state where the rear end portion (upper end portion) of the sheet is fixed by the gripping member 11, and thus the buckling of the sheet bundle is overcome.

Another Embodiment

Although the copying machine is described as the image forming apparatus in the above-described embodiments, the present invention is not limited to this. The image forming apparatus may be a printer or a facsimile machine, or a multifunction machine in which these functions are combined. If the present invention is applied to a sheet processing apparatus used for these image forming apparatuses, the same effect can be obtained.

Although the sheet processing apparatus is detachably attached to the image forming apparatus in the above-described embodiments, the present invention is not limited to this. For example, the sheet processing apparatus may be integrally provided in the image forming apparatus, and if the invention is applied to the sheet processing apparatus, the same effects can be achieved.

Although a plurality of sheets are stacked into a bundle and the bundle is gripped and moved in the above-described embodiments, the invention is also effective for a single sheet in the case of the folding processing. Although the sheet receiving member is disposed on the side where the front end of a sheet in the direction along the inclination of the sheet stacking surface 15*a* is received in the above-described embodiments, a structure in which the rear end of a sheet in the direction along the inclination of the sheet stacking surface 15*a* may slip in the opposite direction along the inclination of the stack tray 15 after the sheet is discharged on the stack tray, or a switch back structure may be employed. That is, the invention is effective even when the sheet receiving member is disposed on the side where the rear end of the sheet in the direction along the inclination of the sheet stacking surface 15*a* is received.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-048962, filed Feb. 29, 2008, and No. 2009-030601, filed Feb. 13, 2009, which are hereby incorporated by reference herein in their entirety.

What is claimed is:

1. A sheet processing apparatus comprising:

a sheet discharge portion configured to discharge a sheet;

a sheet stacking portion on which the sheet, discharged by the sheet discharge portion, is stacked, the sheet stacking portion having a sheet stacking surface which is inclined;

a sheet processing portion configured to process the sheet stacked on the sheet stacking portion;

a sheet receiving member which receives a lower end of the sheet which is discharged to the sheet stacking portion, and is movable in a direction along an inclination of the sheet stacking surface;

a gripping member which grips an upper end portion of the sheet received by the sheet receiving member, and is movable in the direction along the inclination of the sheet stacking surface while gripping the upper end portion of the sheet;

a moving unit which moves the gripping member in the direction along the inclination of the sheet stacking surface; and a controlling portion configured to control the moving unit so that the gripping member is moved in the direction along the inclination of the sheet stacking surface from a lower position where the gripping member grips the upper end portion of the sheet received by the sheet receiving member to an upper position, located above the lower position, corresponding to the sheet processing portion when the sheet processing portion processes the sheet.

2. The sheet processing apparatus according to claim 1, wherein the sheet receiving member is provided with a gripper which grips a lower end portion of the sheet received by the sheet receiving member.

3. The sheet processing apparatus according to claim 2, wherein the sheet stacking surface is inclined such that the gripper is lower than the gripping member in a discharging direction.

4. The sheet processing apparatus according to claim 2, wherein:

the controlling portion is further configured to control movement of the gripper so that the gripper is moved in the direction along the inclination of the sheet stacking surface from a lower position to an upper position located above the lower position, and the controlling portion controls so that the gripping member and the gripper are moved from their respective lower positions to their respective upper positions while both the gripping member and the gripper are gripping the sheet.

5. The sheet processing apparatus according to claim 2, wherein the sheet is processed by the sheet processing portion at a position corresponding to the sheet processing portion while the gripping member and the gripper are gripping the sheet.

6. An image forming apparatus comprising:

an image forming unit configured to form an image on a sheet;

a sheet discharge portion configured to discharge the sheet on which the image is formed;

a sheet stacking portion on which the sheet, discharged by the sheet discharge portion, is stacked, the sheet stacking portion having a sheet stacking surface which is inclined;

a sheet processing portion configured to process the sheet stacked on the sheet stacking portion;

a sheet receiving member which receives a lower end of the sheet which is discharged to the sheet stacking portion, and is movable in a direction along an inclination of the sheet stacking surface;

a gripping member which grips an upper end portion of the sheet received by the sheet receiving member, and is movable in the direction along the inclination of the sheet stacking surface while gripping the upper end portion of the sheet;

a moving unit which moves the gripping member in the direction along the inclination of the sheet stacking surface; and a controlling portion configured to control the moving unit so that the gripping member is moved in the direction along the inclination of the sheet stacking surface from a lower position where the gripping member grips the upper end portion of the sheet received by the sheet receiving member to an upper position, located above the lower position, corresponding to the sheet processing portion when the sheet processing portion processes the sheet.

7. The image forming apparatus according to claim 6, wherein the sheet receiving member is provided with a gripper which grips a lower end portion of the sheet received by the sheet receiving member.

8. The image forming apparatus according to claim 7, wherein the sheet stacking surface is inclined such that the gripper is lower than the gripping member in a discharging direction.

9. The image forming apparatus according to claim 7, wherein:

the controlling portion is further configured to control movement of the gripper so that the gripper is moved in the direction along the inclination of the sheet stacking surface from a lower position to an upper position located above the lower position, and the controlling portion controls so that the gripping member and the gripper are moved from their respective lower positions to their respective upper positions while both the gripping member and the gripper are gripping the sheet.

10. The image forming apparatus according to claim 7, wherein the sheet is processed by the sheet processing portion at the position corresponding to the sheet processing portion while the gripping member and the gripper are gripping the sheet.

* * * * *